US009316000B2

(12) United States Patent
Pendley et al.

(10) Patent No.: US 9,316,000 B2
(45) Date of Patent: Apr. 19, 2016

(54) METHOD OF REPLACING A PREVIOUSLY-INSTALLED DAYLIGHTING PANEL

(71) Applicants: Timothy Pendley, Madera, CA (US); Michael J. McLain, Green Bay, WI (US); Richard McClure, Basehor, KS (US)

(72) Inventors: Timothy Pendley, Madera, CA (US); Michael J. McLain, Green Bay, WI (US); Richard McClure, Basehor, KS (US)

( * ) Notice: Subject to any disclaimer, the term of this patent is extended or adjusted under 35 U.S.C. 154(b) by 0 days.

(21) Appl. No.: 14/714,555

(22) Filed: May 18, 2015

(65) Prior Publication Data

US 2015/0315792 A1 Nov. 5, 2015

Related U.S. Application Data

(62) Division of application No. 14/157,648, filed on Jan. 17, 2014, now Pat. No. 9,032,671.

(51) Int. Cl.
*E04D 13/03* (2006.01)
*E04D 13/04* (2006.01)

(52) U.S. Cl.
CPC ..... *E04D 13/031* (2013.01); *E04D 13/0481* (2013.01); *E04D 13/032* (2013.01); *E04D 13/0305* (2013.01); *E04D 13/0315* (2013.01); *E04D 2013/045* (2013.01); *E04D 2013/0468* (2013.01)

(58) Field of Classification Search
CPC . E04D 13/03; E04D 13/0305; E04D 13/0315; E04D 13/031; E04D 13/0481; E04D 13/032; E04D 2013/045; E04D 2013/0468
See application file for complete search history.

(56) References Cited

U.S. PATENT DOCUMENTS

| | | | |
|---|---|---|---|
| D853,897 | | 5/1907 | Porter |
| 3,521,414 | A | 7/1970 | Malissa |
| 3,791,088 | A | 2/1974 | Sandow et al. |
| 3,802,131 | A | 4/1974 | Resech |

(Continued)

FOREIGN PATENT DOCUMENTS

| | | |
|---|---|---|
| GB | 981948 | 2/1965 |
| JP | 2000336859 | 5/2000 |

(Continued)

OTHER PUBLICATIONS

FAA Facility, photos of skylight installation, 3 pages, Sacramento, CA, prior to 2007.

(Continued)

*Primary Examiner* — Andrew J Triggs
(74) *Attorney, Agent, or Firm* — Thomas D. Wilhelm; Wilhelm Law, S.C.

(57) ABSTRACT

A support structure for supporting loads on a sloping metal panel roof includes first and second side rails, an upper diverter, and a lower closure. An upstanding web of the upper diverter extends upwardly from the panel flat. An elongate lower flange extends from the upstanding web and is disposed against the metal roof panel. Opposing rib mating webs are on opposing sides of the lower flange. On a first side of the lower flange, a diversion leg of the lower flange is between the upstanding web and one of the rib mating webs. On the second side of the lower flange, the second rib mating web meets the upstanding web. The lower flange extends from the upstanding web to a distal end thereof up-slope of the lateral leg. The lower flange and the first and second rib mating webs can, collectively, define a common distal end of the upper diverter.

15 Claims, 13 Drawing Sheets

(56) References Cited

U.S. PATENT DOCUMENTS

| | | | | |
|---|---|---|---|---|
| 3,828,494 | A | 8/1974 | Uhrhane et al. | |
| 3,967,423 | A | 7/1976 | Hammond | |
| 4,117,638 | A | 10/1978 | Kidd, Jr. et al. | |
| 4,123,883 | A | 11/1978 | Barber, Jr. et al. | |
| 4,155,206 | A | 5/1979 | Player | |
| 4,296,581 | A | 10/1981 | Heckelsberg | |
| 4,428,166 | A | 1/1984 | Burghart | |
| 4,470,230 | A | 9/1984 | Weisner | |
| 4,520,604 | A | 6/1985 | Halsey et al. | |
| 4,543,753 | A | 10/1985 | Sonneborn et al. | |
| 4,559,753 | A | 12/1985 | Brueske | |
| 4,621,466 | A | 11/1986 | Sonneborn et al. | |
| 4,649,680 | A | 3/1987 | Weisner et al. | |
| 4,703,596 | A | 11/1987 | Sandow | |
| 4,730,426 | A | 3/1988 | Weisner et al. | |
| 4,776,141 | A | 10/1988 | Powell | |
| 4,825,608 | A | 5/1989 | Makin | |
| 4,848,051 | A | 7/1989 | Weisner et al. | |
| 4,860,511 | A | 8/1989 | Weisner et al. | |
| 4,941,300 | A | 7/1990 | Lyons, Jr. | |
| 4,986,039 | A | 1/1991 | Weisner | |
| 5,018,333 | A | 5/1991 | Bruhm | |
| 5,027,576 | A | 7/1991 | Gustavsson | |
| 5,077,943 | A | 1/1992 | McGady | |
| 5,323,576 | A | 6/1994 | Gumpert et al. | |
| 5,355,644 | A | 10/1994 | Guhl et al. | |
| 5,511,354 | A | 4/1996 | Eidson | |
| 5,522,189 | A | 6/1996 | Mortensen et al. | |
| 5,553,425 | A | 9/1996 | Sampson et al. | |
| 5,561,953 | A | 10/1996 | Rotter | |
| 5,647,175 | A | 7/1997 | Smyth | |
| 5,673,520 | A | 10/1997 | Yannucci, III | |
| 5,675,940 | A | 10/1997 | Bahar | |
| 5,706,610 | A | 1/1998 | Mayle | |
| 5,896,711 | A | 4/1999 | McClure | |
| 5,960,596 | A | 10/1999 | Lyons, Sr. | |
| 6,052,956 | A | 4/2000 | Hoy et al. | |
| 6,079,167 | A | 6/2000 | Voegele, Jr. | |
| D431,174 | S | 9/2000 | Merideth | |
| 6,151,838 | A | 11/2000 | Husein | |
| 6,195,948 | B1 * | 3/2001 | Lamanna | E04D 13/0305 52/200 |
| D448,095 | S | 9/2001 | Merideth | |
| 6,374,549 | B1 | 4/2002 | Mayle | |
| 6,640,508 | B2 | 11/2003 | Lindgren et al. | |
| 6,775,951 | B2 | 8/2004 | Gumpert et al. | |
| 6,848,220 | B2 | 2/2005 | Faurholdt et al. | |
| 6,966,157 | B1 | 11/2005 | Sandow | |
| 7,043,882 | B2 | 5/2006 | Gumpert et al. | |
| 7,263,807 | B2 | 9/2007 | Gumpert | |
| 7,281,359 | B2 | 10/2007 | Marshall | |
| 7,296,388 | B2 | 11/2007 | Valentz et al. | |
| 7,308,777 | B2 | 12/2007 | Sandow | |
| 7,331,145 | B2 | 2/2008 | Feucht et al. | |
| 7,386,958 | B2 | 6/2008 | Quarles | |
| 7,395,636 | B2 | 7/2008 | Blomberg | |
| 7,712,279 | B2 | 5/2010 | McClure | |
| 7,721,493 | B2 | 5/2010 | Skov et al. | |
| 7,736,014 | B2 | 6/2010 | Blomberg | |
| 7,882,664 | B2 | 2/2011 | Lundsgaard et al. | |
| 7,937,900 | B1 * | 5/2011 | Gaffney | E04D 13/0305 52/200 |
| 8,028,478 | B2 | 10/2011 | Valentz et al. | |
| 8,397,468 | B2 | 3/2013 | McClure | |
| 8,438,798 | B2 | 5/2013 | McLain et al. | |
| 8,438,799 | B2 | 5/2013 | McLain et al. | |
| 8,438,800 | B2 | 5/2013 | McLain et al. | |
| 8,438,801 | B2 | 5/2013 | McLain et al. | |
| 8,448,393 | B2 | 5/2013 | Voegele et al. | |
| 8,561,364 | B2 | 10/2013 | Pendley et al. | |
| 8,567,136 | B2 | 10/2013 | Pendley et al. | |
| 8,763,324 | B2 | 7/2014 | Pendley et al. | |
| 8,793,944 | B2 | 8/2014 | Blomberg et al. | |
| 8,833,009 | B2 | 9/2014 | Pendley et al. | |
| 8,844,216 | B2 | 9/2014 | Pendley et al. | |
| 9,027,291 | B2 | 5/2015 | Pendley et al. | |
| 9,032,671 | B1 * | 5/2015 | Pendley | E04D 13/0481 52/97 |
| 2006/0123713 | A1 | 6/2006 | Faurholdt et al. | |
| 2006/0272232 | A1 | 12/2006 | Fooks | |
| 2010/0162643 | A1 | 7/2010 | Blomberg et al. | |
| 2010/0269426 | A1 | 10/2010 | Richter et al. | |
| 2011/0154751 | A1 | 6/2011 | Gumpert | |
| 2013/0283725 | A1 | 10/2013 | Blomberg et al. | |
| 2014/0109497 | A1 | 4/2014 | Pendley et al. | |
| 2014/0260068 | A1 | 9/2014 | Pendley et al. | |
| 2014/0331573 | A1 | 11/2014 | Blomberg et al. | |
| 2014/0352233 | A1 | 12/2014 | Pendley et al. | |
| 2014/0373463 | A1 | 12/2014 | Pendley et al. | |
| 2015/0315792 | A1 * | 11/2015 | Pendley | E04D 13/0481 52/745.15 |

FOREIGN PATENT DOCUMENTS

| | | |
|---|---|---|
| JP | 2001214577 | 8/2001 |
| JP | 2008202372 | 9/2008 |
| WO | 2010040006 | 4/2010 |

OTHER PUBLICATIONS

Cross-section and pictorial views of SSR-TUF-LITE daylighting panels, received Jun. 20, 2012, 1 sheet.

Cross-section of VP TUF-LITE Panel—attached to the side of SSR rib, received Jun. 20, 2012, 1 sheet.

Cross-section of Butler Lite Panel—attached to the side of MR24 rib, received Jun. 20, 2012, 1 sheet.

Siemens Building, photos of skylight installation, 6 pages, prior to 2007.

R & S Manufacturing and Sales Company, Inc., Standing Seam 24 Light, Quick Installation Instructions, Under/Over Seam Clip, 12 pages, Newbury Park, CA, Aug. 2012.

R & S Manufacturing and Sales Company, Inc., SS 24 Light, The First Truely Thermally Broken Metal Building Skylight, informational sheet, 1 page, Newbury Park, CA, Aug. 2012.

R & S Manufacturing and Sales Company, Inc., Enlarged sketch of metal roof showing the down slope, 1 page, Newbury Park, CA, Aug. 2012.

Daljcon, LLC., Butler Manufacturing, www.daljcon.com, Example of 6 Layer Standing Seam, printed Dec. 11, 2012.

* cited by examiner

PRIOR ART
FIG. 2
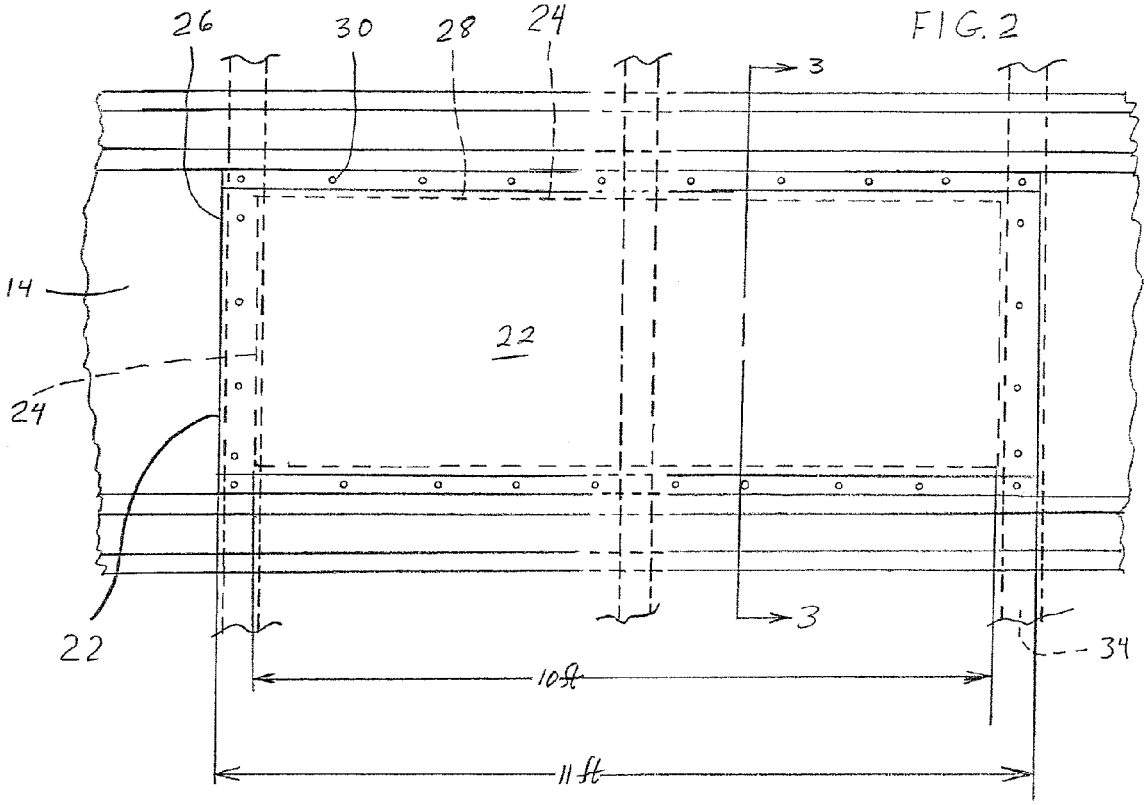
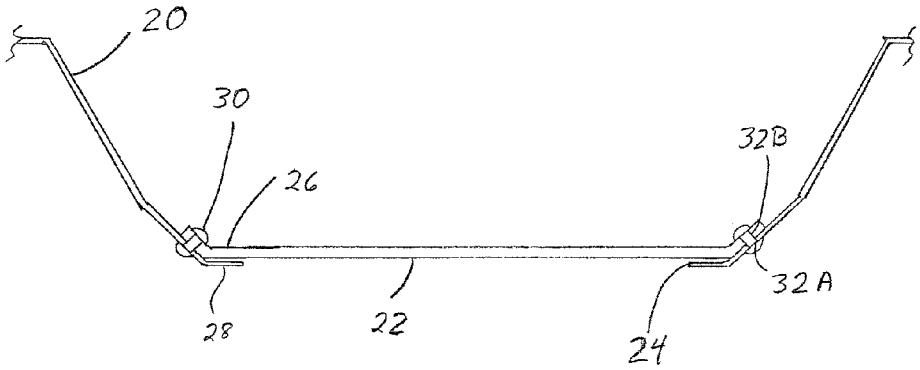
FIG. 3
PRIOR ART

METHOD OF REPLACING A PREVIOUSLY-INSTALLED DAYLIGHTING PANEL

BACKGROUND

Various systems are known for supporting loads on roofs, and for installing skylights and/or smoke vents onto or into roofs.

The present invention relates to skylights and other inserts which are mounted onto or into roofs which use multiple elongate metal roof panels as the exterior roof elements.

Commonly used skylighting systems have translucent or transparent closure members, also known as lenses, mounted on a support structure which extends through an opening in the roof and which is mounted to building framing members inside the building. Ambient daylight passes through such lens and thence through the roof aperture and into the building.

Such conventional skylight and smoke vent installations use structure beneath the exterior roofing panels and inside the building enclosure, in order to support a curb, as the support structure, which extends through the roof, which curb supports the skylight lens. Such conventional skylight curbs, thus, are generally in the form of a preassembled box structure surrounding an opening which extends from the top of the box structure to the bottom of the box structure. Such box structure is mounted, directly or indirectly, to building framing members inside the building enclosure, and extends through a respective opening in the roof, which roof aperture is similar in size and shape to the opening which extends through the box structure. The skylight assembly thus mounts inside the building enclosure, and extends through an opening in a separately mounted roof structure. All known such conventional structures have a tendency to leak water when subjected to rain or melting snow.

In another known skylight structure, an elongate translucent panel/lens is assembled to a metal roof panel which otherwise defines a portion of a standing seam roof. Such metal roof panels are traditionally available in 40 foot lengths. In such skylight structure, a 10-foot section of the metal in the panel flat area of the metal roof panel is removed, creating an aperture in the roof panel, and such metal section is replaced with a fiberglass-reinforced polymeric, translucent panel/lens which transmits light. Such translucent panel has an upper end disposed toward the roof ridge and a lower end disposed toward the roof eave, and is bordered by remaining metal portions of the panel flat of the roof panel at such upper and lower ends. The translucent panel is also bordered on its sides by the upstanding ribs of the metal roof panel. Thus the translucent panel is an insert into an aperture cut into an otherwise-conventional metal roof panel. Such insert is bordered on all sides by the metal of the roof panel which borders the aperture. Overlapping portions of the roof panel metal and the translucent panel are screwed or riveted or otherwise fastened together so as to provide, in combination with tube sealant, a closed and sealed boundary, both at the upper and lower ends of the translucent panel, and along opposing elongate sides of the translucent panel, between the translucent panel and the surrounding roof panel metal. Thus, in such structure, the translucent panel is completely contained within the boundaries of a single metal roof panel; and screws or rivets extend through both the translucent panel and the bordering roof panel metal about the entire perimeter of the translucent panel, such screws or rivets typically being about 1-3 inches from the edge of the aperture. Thus there are holes through the roof panel metal, to receive such screws or rivets, about the entire perimeter of the translucent panel.

In filling a 10-foot long opening, such translucent panel is 11 feet long in order to provide for a 6-inch overlap with the roof panel metal in the panel flat area of the roof panel at both the up-slope and down-slope ends of the translucent panel. In such assembly, the overlap extends beyond both the upper end and the lower end of the 10-foot opening in the roof panel metal.

In a more recent development, a skylight/smoke vent system is contained within the width of a single metal roof panel in a standing seam roof, where the skylight assembly is mounted on, and supported primarily, or solely, by the ribs of the standing seam roof system, such that the skylight/smoke vent system completely surrounds, and extends above, the aperture in the roof, and can expand and contract in accord with ambient outside temperature changes, along with the expansion and contraction of the roof panels. Such skylight/smoke vent systems substantially reduce the incidence of the leakage issue associated with skylights in the metal building industry. Such recently-developed skylight systems, and the roof and buildings into which they are incorporated, are described in U.S. Pat. Nos. 8,438,798, 8,438,799, 8,438,800, 8,438,801, 8,561,364, and 8,567,136, the disclosure of each of which is herein incorporated by reference in its entirety.

In a continuation of the more recent development addressed immediately above, the industry has recognized a desire to replace conventional translucent panels, in the panel flat areas of the roof panels, which are rivet-mounted or screw-mounted about the aperture in the roof panel on already existing buildings, with the more recently-developed skylight assemblies which are mounted on the roof panel ribs. The motivation to replace such in-the-flat translucent panels is driven by the reduced incidence of leakage as well as by potentially greater light transmission through the skylight panel. However, such replacement must address certain legacy issues in order to assure that the replacement skylight systems can be properly sealed against water leakage.

A first issue concerns the screw-mounting holes or rivet-mounting holes which are left about the aperture in the roof panel metal when the in-the-flat panel is removed.

A second issue relates to the screws, the ends of which extend through the roof panel metal and into the building enclosure when the replacement skylight assembly is mounted about/over the aperture.

Addressing the first issue, the replacement assembly must seal, and prevent water leakage through, all of the holes, in the roof panel metal, which holes are used to secure in place the in-the-flat panel which is being replaced.

Addressing the second issue, the positioning of the replacement skylight assembly along the length of the respective roof panel must be such that the screws and/or rivets used to mount the replacement skylight assembly to the roof panel do not overlap any of the roof purlins.

Accordingly, some one or more elements of the skylight assembly must accommodate covering and sealing the previously-used screw/rivet holes while also accommodating keeping the newly-installed screws/rivets, used to mount the replacement skylight assembly, spaced from any and all of the adjacent roof purlins.

It would thus be desirable to provide a skylight assembly which covers and seals the previously-used screw/rivet holes while also keeping the newly-installed screws/rivets, used to mount the replacement skylight assembly, away from any and all of the roof purlins.

It would also be desirable to provide a method of replacing a skylight-type panel, which is mounted primarily in the panel flat of the roof panel, with a skylight assembly which is mounted primarily to, and supported primarily by, the metal roof panel ribs.

SUMMARY

This invention addresses mounting a load on a sloping metal roof. The roof is defined by a plurality of elongate metal roof panels where adjacent roof panels cooperate with each other in defining ribs which extend up from the flat surface of the roof. Such loads are mounted on such roofs using support structures which are mounted solely on such ribs.

In the invention, the support structure includes first and second side rails, an upper diverter, and a lower closure. The upper diverter has an upstanding web which extends upwardly from the panel flat of the roof, an elongate lower flange which resides in the panel flat against the metal roof panel, and opposing rib mating webs on opposing sides of such elongate lower flange. On a first side of the lower flange, a diversion leg of the lower flange is disposed between the upstanding web and a first one of the rib mating webs. On the second side of the lower flange, the second rib mating web meets the upstanding web. The lower flange extends from a proximal end thereof at the upstanding web to a distal end thereof up-slope of the lateral leg of the lower flange. In some embodiments, the lower flange, and the first and second rib mating webs define a common distal end of the upper diverter remote from the upstanding web.

In a first family of embodiments, the invention comprehends an upper diverter, configured to be mounted on a metal roof of a building. Such metal roof is defined by elongate metal roof panels arranged side by side relative to each other. The upper diverter is adapted to be used as part of a load support structure comprising side rails and a lower closure, which load support structure is adapted to support a load on the roof, and wherein the upper diverter diverts water transversely away from the load support structure, the upper diverter having a first length adapted to extend along a length of a such metal roof panel to which the upper diverter is mounted, and a first width adapted to extend along a width of such metal roof panel, the upper diverter comprising a lower flange, the lower flange having a second length extending along the first length of the upper diverter; an upstanding wall having a top and a bottom, first and second ends, and a third length extending between the first and second ends and along the first width of the upper diverter, the upstanding wall forming a joint with the lower flange at the bottom of the upstanding wall, the joint extending generally along the second length of the lower flange; and an upper flange joined to, and extending down-slope from, the top of the upstanding wall, the upper flange having third and fourth ends, the second length of the lower flange extending from a down-slope end thereof at the upstanding wall to an up-slope end thereof remote from the upstanding wall, the lower flange having a lateral leg which extends, along the width of the upper diverter and beyond the third end of the upper flange, the lateral leg having a down-slope side and an up-slope side, the second length of the lower flange extending beyond, and up-slope from, the up-slope side of the lateral leg.

In some embodiments, the lower flange has a top surface and a bottom surface and opposing first and second sides extending along the length of the lower flange, the lower flange further comprising first and second rib mating webs extending upwardly from, and transverse to, the top surface of the lower flange at the opposing first and second sides of the lower flange.

In some embodiments, the support structure further comprises first and second side rails, a lower closure, and an upper diverter as in claim 1.

In a second family of embodiments, the invention comprehends an upper diverter, configured to be mounted on a metal roof of a building, such metal roof being defined by elongate metal roof panels arranged side by side relative to each other. The upper diverter is adapted to be used as part of a load support structure comprising side rails and a lower closure, which load support structure is adapted to support a load on the roof, and wherein the upper diverter diverts water transversely away from such load support structure, the upper diverter having a first length adapted to extend along a length of a such metal roof panel to which said upper diverter can be mounted, and a first width adapted to extend along a width of such metal roof panel, the upper diverter comprising a lower flange, the lower flange having a top surface and a bottom surface, first and second ends, and opposing first and second sides, and a second lower flange length extending along the first length of the upper diverter, and from the first end to the second end; an upstanding wall having third and fourth ends, and a third length extending between the third and fourth ends and along the first width of the upper diverter, the upstanding wall forming a joint with the lower flange at a lower edge of the upstanding wall, the joint extending generally along the second length of the lower flange; and first and second rib mating webs extending upwardly from, and transverse to, the top surface of the lower flange, at the opposing first and second sides of the lower flange.

In some embodiments, the lower flange has a lateral leg which extends, along the width of the upper diverter and beyond the third end of the upstanding wall, the lateral leg having a down-slope side and an up-slope side, one of the rib mating webs being displaced from the upstanding wall such that the lateral leg is disposed between the one rib mating web and the upstanding wall.

In some embodiments, the invention comprehends a support structure for supporting a load on a roof, the support structure comprising first and second side rails, a lower closure, and such upper diverter.

In a third family of embodiments, the invention comprehends a method of replacing a previously-installed daylighting lens mounted on a metal roof panel of a standing seam metal panel roof on an underlying building, such roof panel having opposing first and second sides, a length, and a width between the first and second sides, first and second rib elements being disposed on the opposing first and second sides of the roof panel, and a panel flat being disposed between the rib elements, the rib elements of adjacent such metal roof panels being joined to each other in defining ribs on opposing sides of each such roof panel, such daylighting lens covering an aperture in such roof panel, such aperture extending along a length of such roof panel, in the area of the panel flat and proximate the elevation of the panel flat, such daylighting lens optionally overlying portions, preferably no more than lower portions, of such rib elements, such daylighting lens having an up-slope end at the locus of the panel flat and a down-slope end proximate the locus of the panel flat, and wherein mechanical fasteners mount such daylight lens to such roof at such panel flat, such mechanical fasteners extending through holes in such metal panel roof, including holes in the panel flat of the roof panel up-slope of the aperture, and wherein at least some of such holes in the panel flat up-slope of such aperture are spaced from such aperture by at least 2 inches. The method comprises removing the previously-installed daylighting panel from the metal roof panel, including removing the mechanical fasteners from the daylighting panel and the metal roof panel and thereby exposing the aperture in the roof panel to the ambient environment, which exposes an access path through the aperture and into the underlying building, and leaves, in the metal roof panel, the fastener holes which had been used to mount the daylighting panel to the roof panel; mounting a support structure to the roof and about the aperture, the support structure comprising first and second side rails mounted to respective ones of the ribs and thereby defining opposing sides of the support structure, each such side rail having an up-slope end and a down-slope end, a lower closure mounted to the roof such that the lower closure extends across a width of the support structure from the first side rail to the second side rail, and closes off access to the aperture from outside the building and down-slope of the support structure, and closes off access to any pre-existing fastener holes in the metal roof panel which are down-slope of the aperture, and an upper diverter mounted to the roof, the upper diverter having a length extending in a common direction with the length of the respective roof panel, and a width extending in a common direction with the width of the respective roof panel, the upper diverter extending across the width of the support structure from the first side rail to the second side rail, and closing off access to the aperture from up-slope of the support structure, and closing off access to any pre-existing fastener holes in the metal roof panel which are up-slope of the aperture, the upper diverter comprising a lower flange having a length extending along the length of the upper diverter, and an upstanding wall having first and second ends, and a length extending between the first and second ends and along the width of the upper diverter, the upstanding wall forming a joint with the lower flange at a lower edge of the upstanding wall, the length of the lower flange extending from a down-slope end thereof at the upstanding wall, past all such pre-existing holes in the panel flat, to an up-slope end thereof remote from the upstanding wall and thereby closing off access, from outside the building, to any such pre-existing fastener holes in the panel flat, which are up-slope of the aperture; and mounting a daylighting lens assembly, comprising a daylighting lens, over the support structure and thereby closing off the access path into the underlying building.

In some embodiments, the support structure further comprises an upper flange joined to, and extending transversely to, the top of the upstanding wall, the upper flange having third and fourth ends, the lower flange having a lateral leg which extends along the width of the upper diverter and beyond the third end of the upper flange, the lateral leg having a down-slope side and an up-slope side, the length of the lower flange extending beyond, and up-slope from, the up-slope side of the lateral leg.

In some embodiments, the lower flange has a top surface and a bottom surface, first and second ends, and opposing first and second sides, the upper diverter further comprising first and second rib mating webs extending upwardly from, and transverse to, the top surface of the lower flange at the opposing first and second sides of the lower flange.

In some embodiments, the side rails extend upwardly above the roof panel ribs.

In some embodiments, the daylighting lens extends across the support structure at an elevation above the roof panel ribs.

BRIEF DESCRIPTION OF THE DRAWINGS

A more complete understanding of the present invention and the attendant features and advantages thereof may be had by reference to the following detailed description when considered in combination with the accompanying drawings wherein the various figures depict the elements, subassemblies, and assemblies of the invention.

FIGS. 2 and 2A are plan views of prior art in-the-flat metal roof panel assemblies which include a length of translucent light-transmitting panel in the panel flat of a metal roof panel.

FIG. 3 is a cross-section view of the in-the-flat metal roof panel assembly taken at of FIG. 2.

Figure 1:
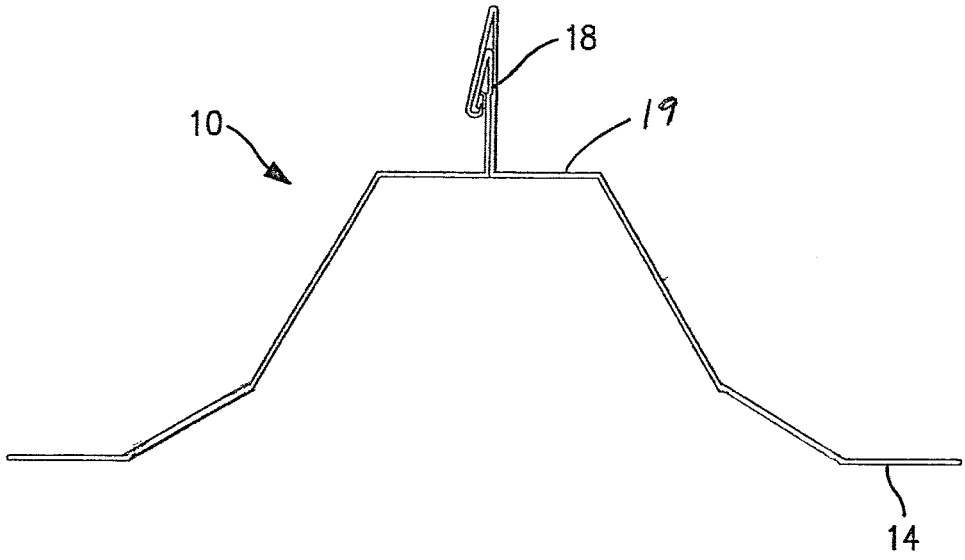
FIG. 1 PRIOR ART
FIG. 1 is a roof profile of a metal roof of the type known as a standing seam roof.

The invention is not limited in its application to the details of construction, or to the arrangement of the components set forth in the following description or illustrated in the drawings. The invention is capable of other embodiments or of being practiced or carried out in various other ways. Also, it is to be understood that the terminology and phraseology employed herein is for purpose of description and illustration and should not be regarded as limiting. Like reference numerals are used to indicate like components.

DESCRIPTION OF THE ILLUSTRATED EMBODIMENTS

The products and methods of the present invention provide a load support structure, for use in installing various exterior roof loads, including structures which close off apertures, in sloping metal panel roofs. For purposes of simplicity, "support structure" will be used interchangeably to mean various forms of structures which are mounted on ribs of raised elevation metal roof structures, and which may surround an aperture in the roof, including across the flat of a roof panel, and which structures support e.g. a closure over the opening, or a conduit which extends through the roof aperture. Skylight assemblies and smoke vents are non-limiting examples of closures over such roof apertures. Air handling operations such as vents, air intakes, and air or other gaseous exchange to and/or from the interior of the building are non-limiting examples of operations where conduits extend through the roof aperture. In the case of roof ventilation, examples include simple ventilation apertures, such as for roof fans, and smoke vents, which are used to allow the escape of smoke through the roof during fires. In the case of exterior loads on the roof, where no substantial roof aperture is necessarily involved, there can be mentioned, without limitation, such loads as air conditioners, air handlers, solar panels and other equipment related building utilities, and/or to controlling water or air temperatures inside the building. The only limitation regarding the loads to be supported is that the magnitude of a load must be within the load-bearing capacity of the roof panel or panels to which the load is mounted.

The number of skylights or other roof loads can vary from one load structure, to as many load structures as the building roof can support, limited only by the amount of support available from the respective roof panels to which the load is attached.

The invention provides structure and installation processes, as a closure system which utilizes the beam-like strength of the standing seams, in the roof panels, as the primary support for the load, supporting e.g. a downwardly-directed load on the roof.

One family of support structures of the invention comprehends a skylight system which does not require support from the building framing inside the climate-controlled building enclosure for the purpose of supporting the skylight installation. Rather, the support structure of the invention, which supports such skylights, is overlaid onto, and mounted to, the ribs of the metal roof panels, and exposes the support structure to the same ambient weather conditions which are experienced by the surrounding roof panels, whereby the support structure experiences approximately the same thermal expansions and contractions as are experienced by the respective roof panel or panels to which the support structure is mounted. This is accomplished through direct attachment of the support structures of the invention, which support a skylight assembly, to the underlying metal roof panels. According to such roof mounting, and such ambient weather exposure, expansion and contraction of the support structure of the invention generally coincides, at least in direction, with concurrent expansion and contraction of the metal roof panels.

Referring now to the drawings, a given metal roof panel generally extends from the eave of the roof to the peak. Skylight systems of the invention contemplate the installation of a single skylight assembly, or two or more adjacent skylight assemblies in an end to end relationship along the major rib structure of a given such metal roof panel on the building whereby the individual skylight assemblies may be installed individually, or in strips over a continuous, uninterrupted aperture in the metal panel roof, the aperture extending along a line which extends from the roof eave to the corresponding ridge.

Skylight systems of the invention can be applied to various types of ribbed roof profiles. FIG. 1 is illustrative, showing an end view of a roof profile of a metal roof of the type known as a standing seam roof. Such "standing seam" roof has trapezoidal elevated elongate major ribs 20 typically 24" to 30" on center. Each roof panel 10 also includes a panel flat 14, and may include one or more other elements such as distinct panel surfaces between the rib 20 and the panel flat. The elevated ribs on a given panel extend upwardly to top flat rib surfaces 19, and extend up from the top flat rib surfaces to edge regions which cooperate with edge regions of corresponding elevated elongate ribs on next-adjacent panels, thus forming standing seams 18. Standing seams 18 represent the edge regions of adjacent roof panels, folded one over the other, to form elongate joints at the side edges of the respective roof panels. The edge regions of the rib elevations on respective adjacent panels are, together, folded over such that the standing seam functions as a folded-over raised joint between the respective panels, thus to inhibit water penetration of the roof at the standing seam/joint. The profiles of standing seam structures vary from manufacturer to manufacturer, but all such structures/designs include elongate ribs supporting standing, folded-over seams.

A skylight/ventilation support structure is illustrative of support structures of the invention which close off roof-penetrating apertures. Such support structure can comprise a rail and closure structure which surrounds an aperture in the roof, and which is adapted to be mounted on, and supported by, prominent standing elevations, standing rib structures, or other upstanding elements of conventional roof panels, where the standing structures of the roof panels, namely structure which extends above the panel flats, e.g. at seams/joints where adjoining metal roof panels are joined to each other, provides the support for the support structures. A such rail and closure support structure is secured/attached/mounted to one of the conventional metal roof panels, and surrounds a roof aperture formed largely or entirely in the intervening flat region of a single metal roof panel. The exact profile of a given support structure is designed to follow/match the profile of the roof panel with which that support structure is intended to be used.

Figure 2A:
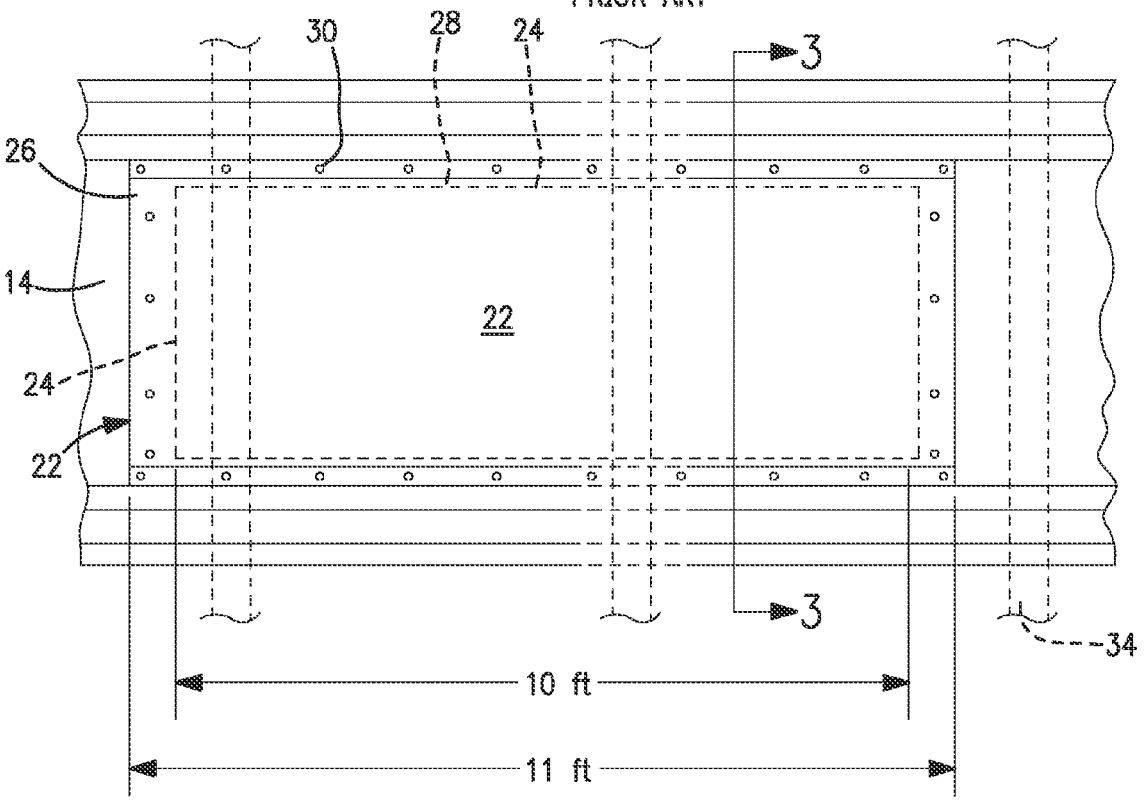
FIG. 2A PRIOR ART

FIGS. 2 and 3 illustrate a prior art in-the-flat light-transmitting translucent skylight panel 22 overlying an aperture 24 in the metal roof panel. Aperture 24, as illustrated in FIG. 2, underlies panel 22, and thus is shown in dashed outline. Aperture 24 has a length of 10 feet, and a width which overlies most, but less than all, of the panel flat in the respective metal roof panel.

Translucent skylight panel 22, as illustrated, has a length of 11 feet and a width which overlies all of the panel flat of the roof panel, as well as the edges of the translucent panel extending up onto the lower portion of the respective adjacent ribs 20. The length and width of the translucent panel thus overlies the entirety of the length and width of aperture 24, such that border areas 26 of the translucent panel overlie respective border areas 28 of the metal roof panel adjacent the edges of aperture 24.

The respective border areas of the translucent panel and the metal roof panel are secured to each other by a series of mechanical fasteners, such as screws or rivets 30, spaced about the border areas of the translucent panel and the metal roof panel adjacent the aperture. Such mechanical fasteners extend through holes 32A in the metal roof panel and holes 32B in the translucent panel and, and draw the respective adjacent portions of the metal roof panel and the translucent panel into effective sealing contact with each other, typically with tube sealant between such surfaces providing the final seal between the metal roof panel and the translucent panel.

The location of aperture 24, and thus the location of translucent panel 22, are selected such that the border regions at the opposing ends of the translucent panel overlie, and are supported by, adjacent purlins 34 in the roof support structure of the building.

Figure 4:
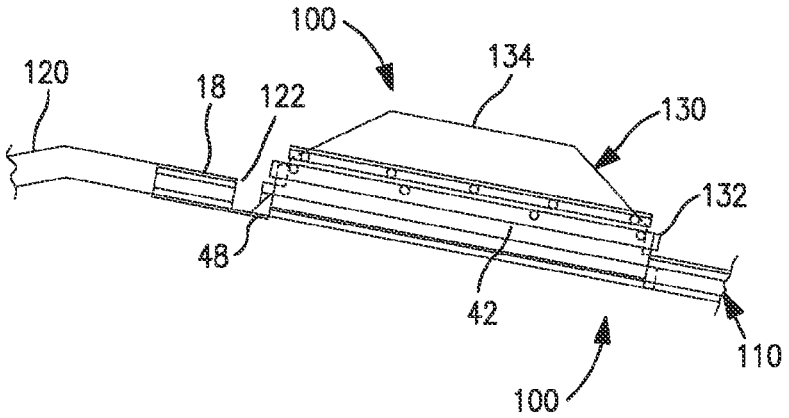
FIG. 4 is a side view of a skylight system of the invention, installed on a metal roof.

FIG. 4 shows a side view of an exemplary support structure 100 of the invention, mounted to a standing seam panel roof 110 of a building, and extending about an aperture 24 in that metal roof panel. Aperture 24 represents an access path from the outside atmosphere into the interior of the space enclosed by the underlying building. Aperture 24 thus represents both an access path for light to enter the building as well as an access path for rain, snow and like precipitation to enter the enclosed space inside the building. A skylight lens assembly 130 overlies both support structure 100 and aperture 24, thus closing off the access path for entrance of precipitation into the building while providing for light to continue to be able to enter the building. Thus the critical feature of a successful skylight assembly is to allow light to enter the building while excluding entrance into the building, of liquid and/or solid water in its various states such as rain, snow, sleet, or melted forms of solid state water.

Figure 5:
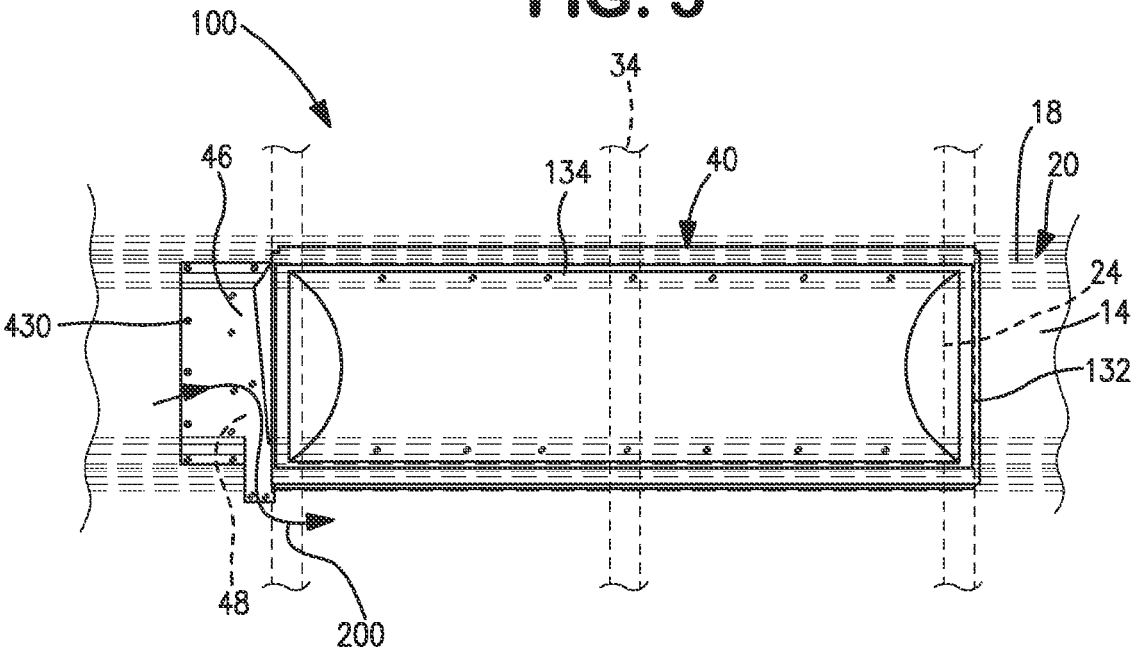
FIGS. 5 and 5A are top views of installed skylight systems similar to that in FIG. 4, showing placement of the skylights and the directions of water flow around the skylights.
Figure 5A:
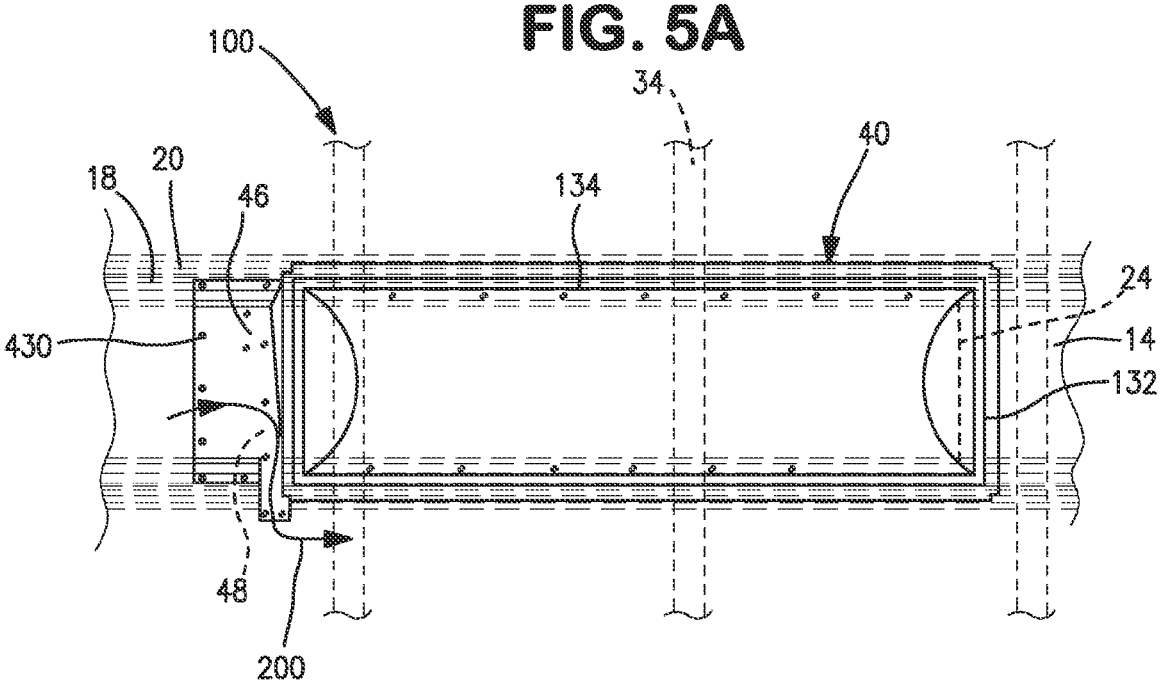

FIG. 5 shows a portion of the roof 110 of FIG. 4, in dashed outline, with an extended-length skylight assembly of the invention over a 10-foot long aperture 24, such as an aperture left after an 11-foot long in-the-flat panel has been removed from overlying the aperture, leaving holes 32A in the metal roof panel about the border areas 28 of the metal roof panel. The roof has raised ribs 20, panel flats 14, and standing seams 18. Given that water generally seeks the lowest level available at any given location, any water on a given such sloping roof panel tends to congregate/gather on the upper surface of the panel flat whereby, except for any dams across the panel flat, the water line is generally limited to the panel flat and slightly above the panel flat. Thus, most of rib 20, and all of standing seam 18, are typically above the water line. Also depicted in FIGS. 4 and 5 are ridge cap 120 of the roof structure, and cutaway regions, or gaps 122 in the raised ribs 20.

Skylight lens assembly 130 is part of the closure system for closing off the access path at the aperture. Lens assembly 130 generally comprises a skylight lens frame 132 mounted to the closure support structure and extending along at least 3 sides of a rectangular perimeter of the closure support structure. Lens assembly 130 further comprises a skylight lens 134 mounted to frame 132. An exemplary such skylight lens is that taught in U.S. Pat. No. 7,395,636 Blomberg and available from Sunoptics Prismatic Skylights, Sacramento, Calif.

Still referring to FIGS. 4 and 5, support structure 100 of the invention, as applied to a skylight installation, includes a rail and closure structure 40. Such rail and closure structure includes side rails 42 and 44 (FIGS. 6, 7), upper diverter 46, and a lower closure 50.

Figure 6:
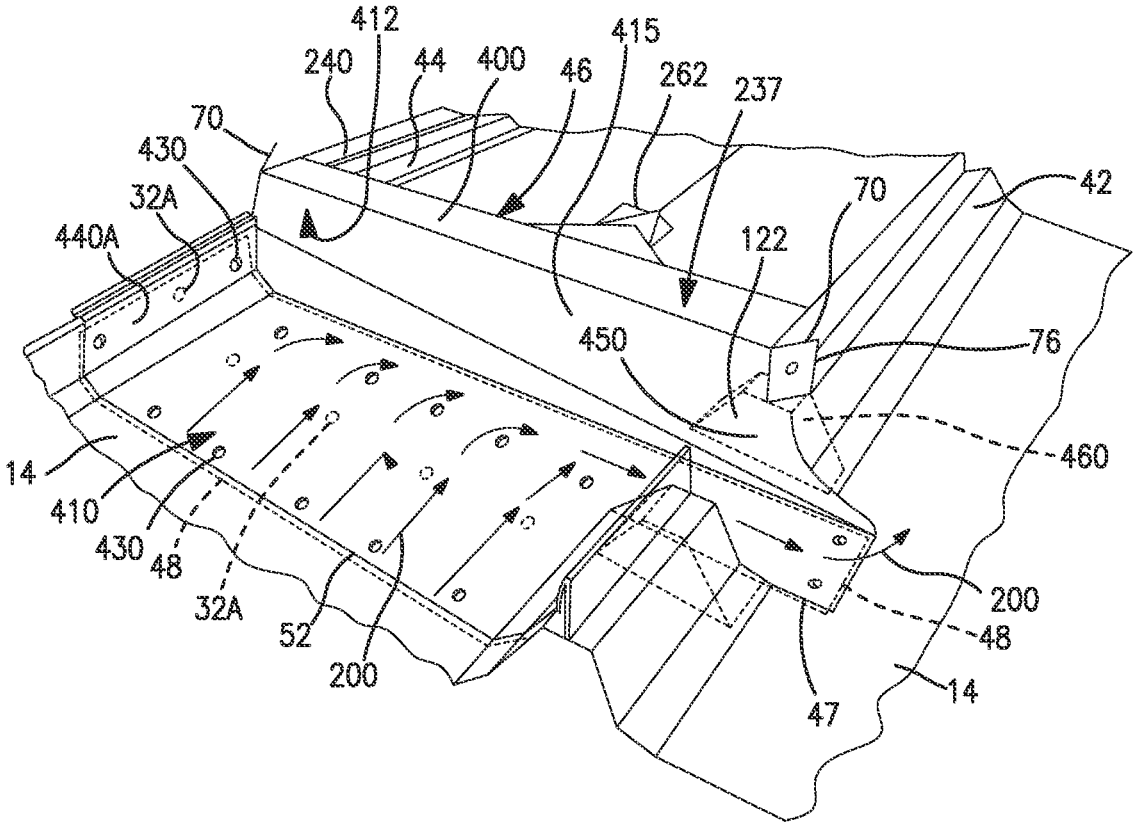
FIG. 6 is a cut-away pictorial view showing an upper diverter of the invention mounted in the panel flat area, and extending through the rib gap.
Figure 10:
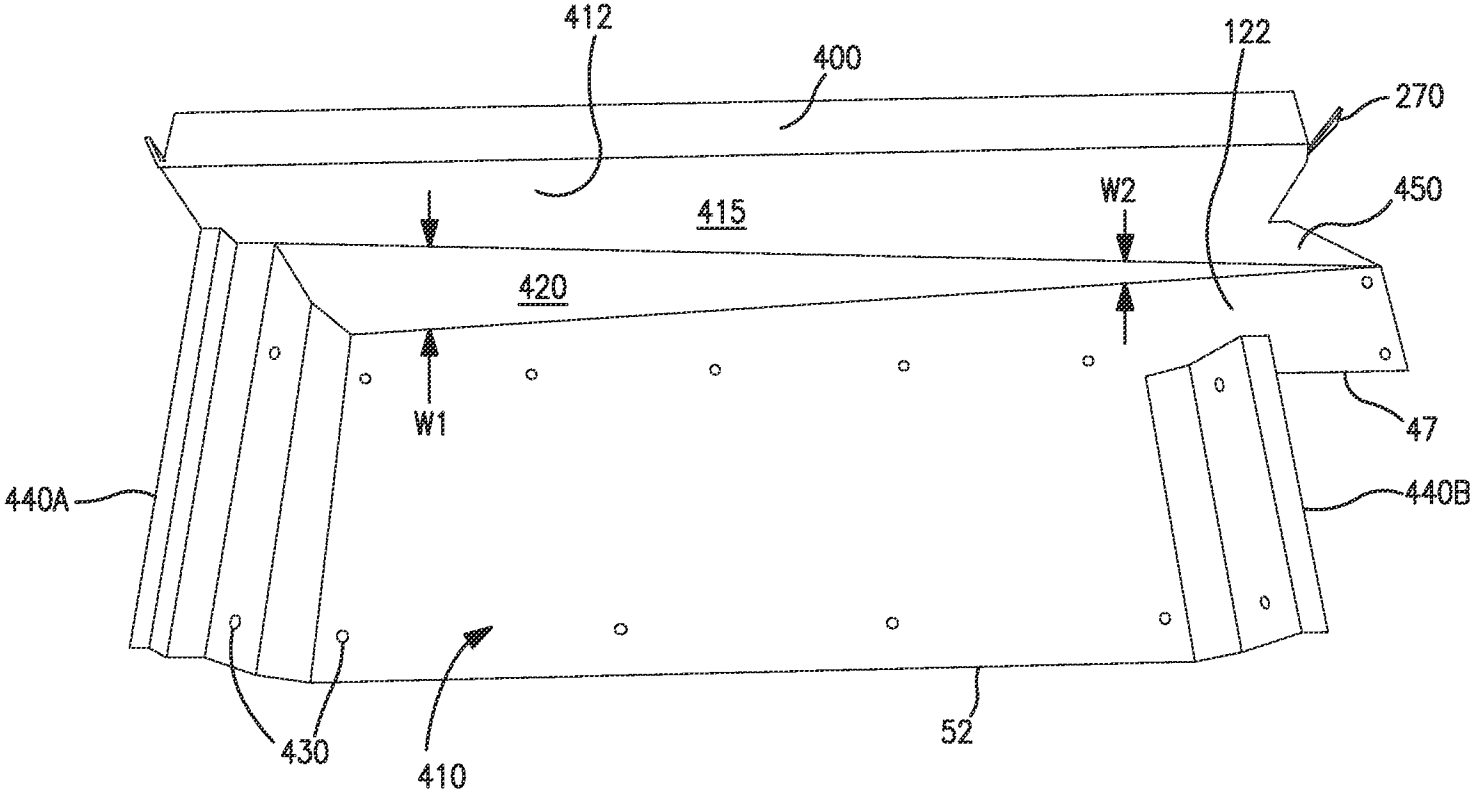
FIG. 10 is a perspective view of an extended-length upper diverter of the invention.
Figure 11:
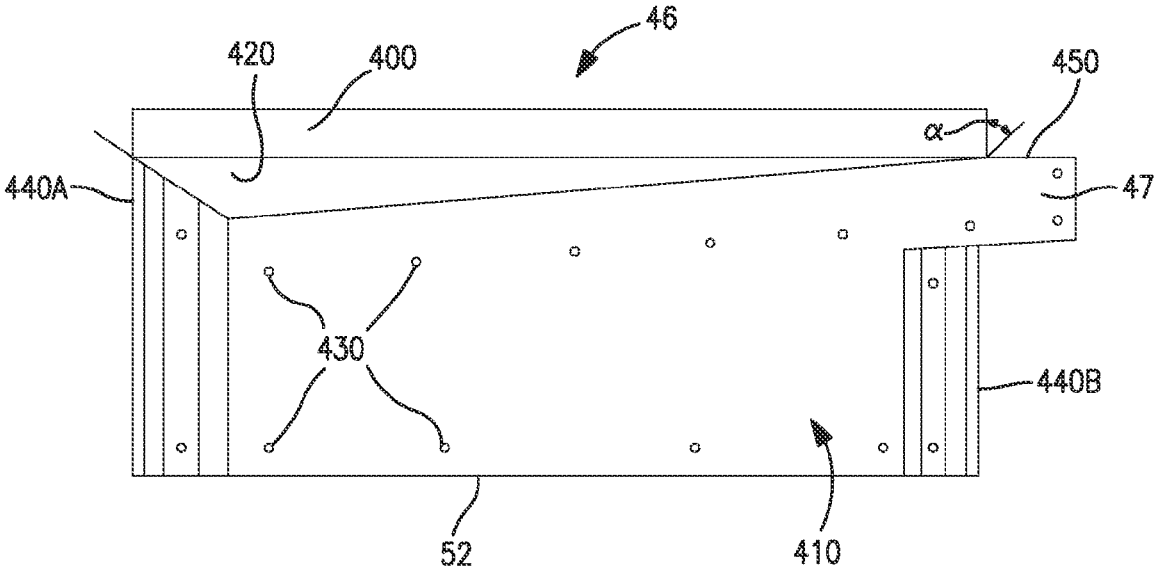
FIG. 11 is a top view of the upper diverter of FIG. 10.
Figure 12:
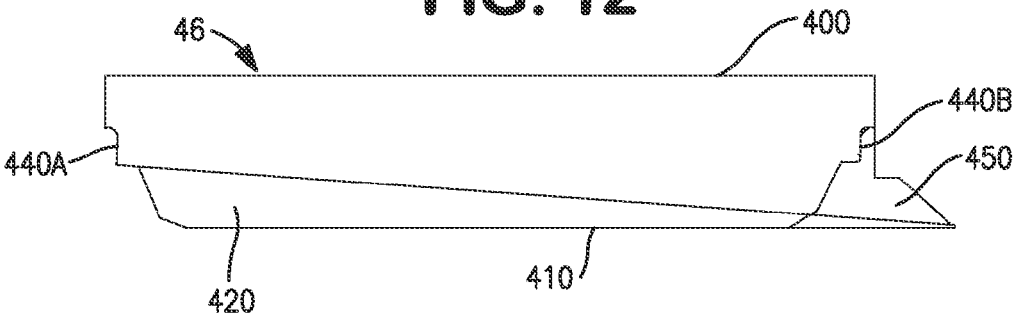
FIG. 12 is a front elevation view of the upper diverter of FIG. 10.

FIGS. 6, 10 and 11 show diverter ears 70 on opposing ends of the upper diverter. An ear 70 is shown in FIG. 11, in top view, at an angle $\alpha$ of about 45 degrees to the end of bearing panel 400 of the diverter. After the upper diverter has been assembled to a rail, the corresponding ear is bent flat against the respective upstanding web 238 of the rail. After the ear has been bent flat against the rail upstanding web, ear 70 is secured to upstanding web 238 by driving a screw through aperture 76 and into the upstanding web.

Looking now to FIGS. 6, and 10 through 12, upper diverter 46 extends between rails 42, 44, and provides end closure, and a weather tight seal, of the rail and closure structure, at the upper end of the roof aperture, and diverts water around the upper end of the opening, to the flat portion 14 of an adjacent panel. The up-slope ends of side rails 42 and 44 abut the down-slope side of diverter 46 and the height of diverter 46 closely matches the height of the side rails. Bearing panel 400 of diverter 46 thus acts with bearing panels 240 of side rails 42 and 44, and an upper surface of lower closure 50, to form the upper surface of the rail and closure structure, to which the skylight lens frame 132 is mounted, as well as surrounding the access path which extends upwardly through the corresponding aperture in the roof panel.

Upper diverter 46 includes an end panel 412, an upper flange 400, a lower flange 410, and first and second rib mating webs 440A and 440B.

End panel 412 includes an upstanding web 415 which extends down from upper flange 400, and a diversion panel 420 which extends down from upstanding web 415 to the bottom of the end panel. Lower flange 410 extends across the full width of the panel flat, through gap 122 in the adjacent rib, and upstream along the panel flat, away from end panel 412, upstream of gap 122, and beyond holes 32A in the panel flat to a distal upstream edge of the lower flange.

Extension 450 of upper web 415 functions as an end closure, closing off rib 20 on the down-slope side of gap 122. Extension 450 further functions to divert water across the respective rib 20 and onto the panel flat portion 14 of the adjacent roof panel. Extension 450 extends through gap 122 and across the respective otherwise-open end of the rib. Hard rubber rib plugs 460, along with suitable tape mastic and caulk or other sealants, are inserted into the cut ends of the rib on both the up-slope side and the down-slope side of gap 122. The up-slope side plug, plus tube sealants, serve as the primary barrier to water entry on the up-slope side of gap 122. Extension 450 serves as the primary barrier to water entry on the down-slope side of gap 122, with plug 460, in combination with tube sealant, serving as a back-up barrier.

Upper web 415 is generally perpendicular to the panel flat 14 of the underlying metal roof panel. Lower flange 410 extends generally parallel to the underlying panel flat. Looking at end wall 412 from up-slope of the upper diverter, diversion panel 420 defines a first obtuse angle with upper web 415 and a second obtuse angle with the lower flange. Diversion panel 420 thus bridges between lower flange 410 and upper web 415. The lower edge of diversion panel 420 which is remote from gap 122 extends across the panel flat area along a downward slope which progressively approaches an imaginary downward perpendicular projection of upper web 415 to the elevation of the panel flat. Thus, the diversion panel provides primary direction, causing water to flow along the lower edge of the diversion panel toward gap 122.

As illustrated in FIG. 6, lower flange 410 runs along, parallel to, and in general facing contact with, panel flat 14 of the respective roof panel. A lateral leg 47 of the lower flange extends through gap 122, which gap extends through the cut rib. Lateral leg 47 covers the bottom of gap 122. Extension 450 of upper web 415 extends upwardly from the lateral leg and/or the diversion panel and acts as an upright barrier against water penetration into support structure 100 at the down-slope side of the gap. Diversion panel 420 provides the primary direction causing water to flow toward gap 122. Once the water arrives at gap 122, lateral leg 47 and extension 450 convey the water through gap 122 and onto the panel flat of the next adjacent metal roof panel, thus to direct the water away from the upper end of the skylight and, correspondingly, to prevent water from leaking through the roof aperture.

Lower flange 410 and the rib mating webs 440A, 440B are in general surface-to-surface contact with the metal roof panel. That general contact is interrupted by use of tube sealant over substantially all of such contact area, whereby such tube sealant is considered to be part of such "contact".

Referring to FIG. 6, underlying the lower flange 410 and rib mating webs 440A and 440B is a support plate 48. Support plate 48 extends from approximately the lower edge of diversion panel 420 up-slope to approximately the distal edge 52 of lower flange 410, through gap 122 underlying lateral leg 47, and upwardly along the respective opposing ribs such that the rib sheet metal is between the support plate and the respective rib mating webs. The sheet metal of conventional metal roof panels is too thin to reliably hold a sheet metal screw. Support plate 48 is specified sufficiently thick, for example and without limitation about 0.06 inch to about 0.09 inch thick; namely thick enough that the support plate acts as a nut receiving the sheet metal screws which may be used at holes 430. Thus, screws and/or rivets, or other mechanical fasteners, can be applied through holes 430 to draw the lower flange tight against the metal of the roof panel, with the tube sealant between the lower flange and the roof panel filling any voids between those two surfaces, whereby application of such mechanical fasteners provides an effective seal preventing water from entering the space protected by the support structure at the upper diverter.

The minimum acceptable measured length of the lower flange, from upper web 412 to distal end 52 is that length which both (i) covers any holes 32A and (ii) provides enough length from holes 32A to accommodate a line of fastening holes 430 proximate distal edge 52. As shown in FIG. 6 an optional second line of fastening holes 430 may be employed proximate the proximal end of lower flange 410. The invention contemplates that the distal edge of the lower flange is up-slope of gap 122 whereby a rib mating web, described hereinafter, extends upwardly onto the rib which is adjacent gap 122.

FIG. 6 illustrates, in dashed outline, the holes 32A which were left in the roof panel metal upstream of aperture 24, in the panel flat and on the sides of the ribs, after an in-the-flat daylighting panel, such as that illustrated in FIGS. 2 and 3, was removed. Corresponding holes 32A on the sides of the ribs adjacent side rails 42, 44 are enclosed within the space sealed closed by the support structure. Holes 32A at the downstream end of the support structure are also within the space sealed closed by the support structure. Given that the holes 32A at the downstream end of the support structure are within the space sealed closed, the holes 32A at the upstream end of the support structure are upstream of gap 122.

At the side of lower flange 410, which is closer to the closed rib, is a first rib mating web 440A. As illustrated in FIG. 6, rib mating web 440A contains multiple panels which extend up from the panel flat in a profile which matches the profile of the underlying rib so as to be in general surface-to-surface contact with the underlying rib over substantially all of the surface of rib mating web 440A. Rib mating web 440A extends at least high enough above the panel flat, and extends far enough away from end panel 412, to cover any holes 32A which were left from the mounting of a previously-removed daylighting panel.

At the end of lower flange 410, which is closer to gap 122, is a second rib mating web 440B. Rib mating web 440B contains multiple panels which extend up from the panel flat in a profile which matches the profile of the underlying rib adjacent gap 122 so as to be in general surface-to-surface contact with the respective underlying rib over substantially all of the surface of the respective rib mating web. Rib mating web 440B extends at least high enough above the panel flat, and extends far enough away from end panel 412, to cover any holes 32A which were left from the mounting of such previously-removed daylighting panel.

In order to cover such previously-used holes, and in order to avoid the risk of entering those same holes with mechanical fasteners used to secure the instant support structure to the roof at the upstream end of the aperture, lower flange 410 extends a sufficient distance from upper web 412 to cover any such holes 32A.

Fastener holes 430 are spaced along the length of lower flange 410 and extend through lower flange 410 for securing the lower flange to support plate structure 48 in the panel flat, with the roof panel trapped between the lower flange and the support plate structure. As illustrated, end panel 412 has a diversion panel 420. Diversion panel 420 is, without limitation, typically a flat surface defining first and second obtuse angles with lower flange 410 and with an upper web 415 of end panel 412. As indicated in FIG. 10, diversion panel 420 has relatively greater width "W1" on the side of the closure structure which is against the rib which is not cut, and a relatively lesser width "W2", approaching a nil dimension, adjacent rib gap 122, thus to divert water toward gap 122.

Rail and closure structure 40 further includes connectors, bridging members, and rubber or plastic plugs to make various connections to the rail and closure structure elements as well as to close gaps/spaces between the various rail and closure structure elements, and between the roof panels and the rail and closure structure elements, thus to complete the seals which prevent water leakage about the skylight and the associated aperture 24.

FIGS. 4-6 and 10 show how gap 122 in rib 20, in combination with upper diverter 46, provides for water flow, as illustrated by arrows 200, causing the water to move laterally along the roof surface, over lateral leg 47 of the upper diverter, and down and away from the roof ridge cap 120 in panel flat 14 of the roof panel which is next adjacent the roof structures which support the respective e.g. skylight.

Lower closure 50 closes off the roof aperture from the outside elements at the lower end of the e.g. skylight, thus to serve as a barrier to water leakage at the lower end of the opening in the roof.

Figure 7:
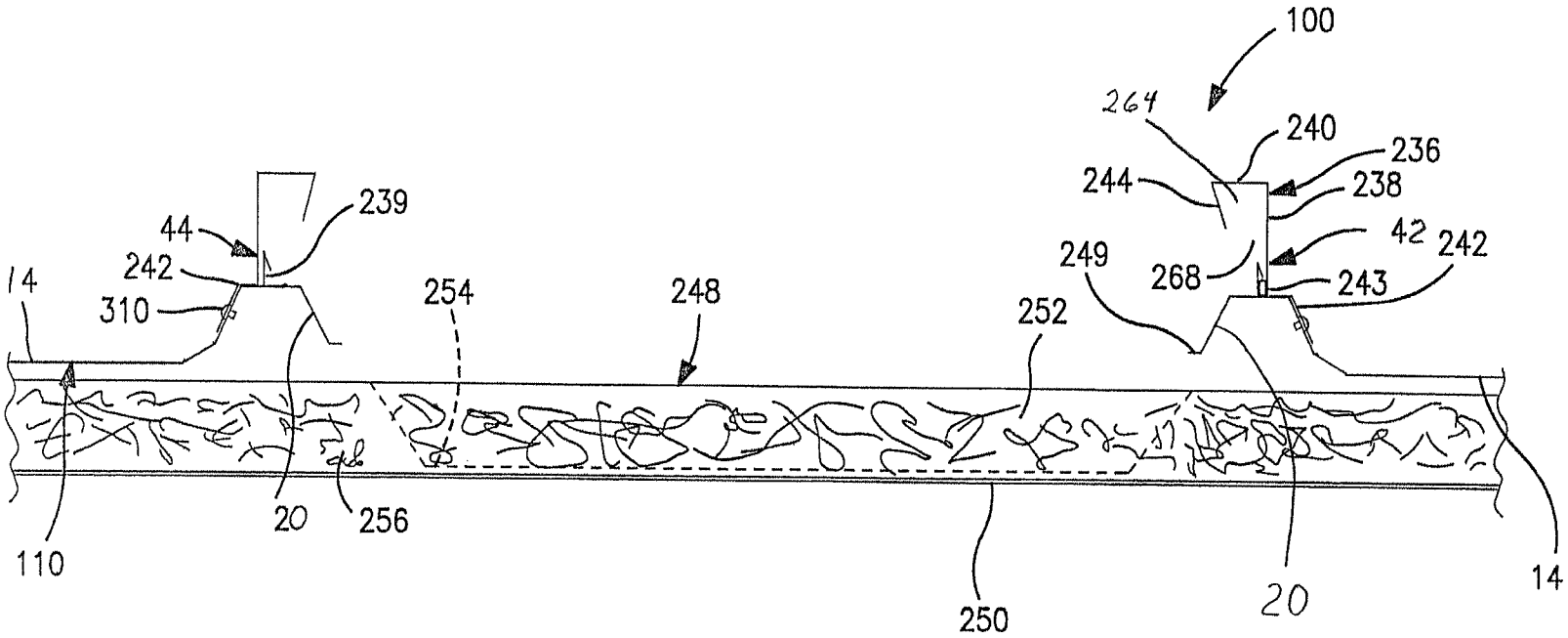
FIG. 7 is a cross sectional view showing the connections of the side rails to the rib elevations in the invention.
Figure 8:
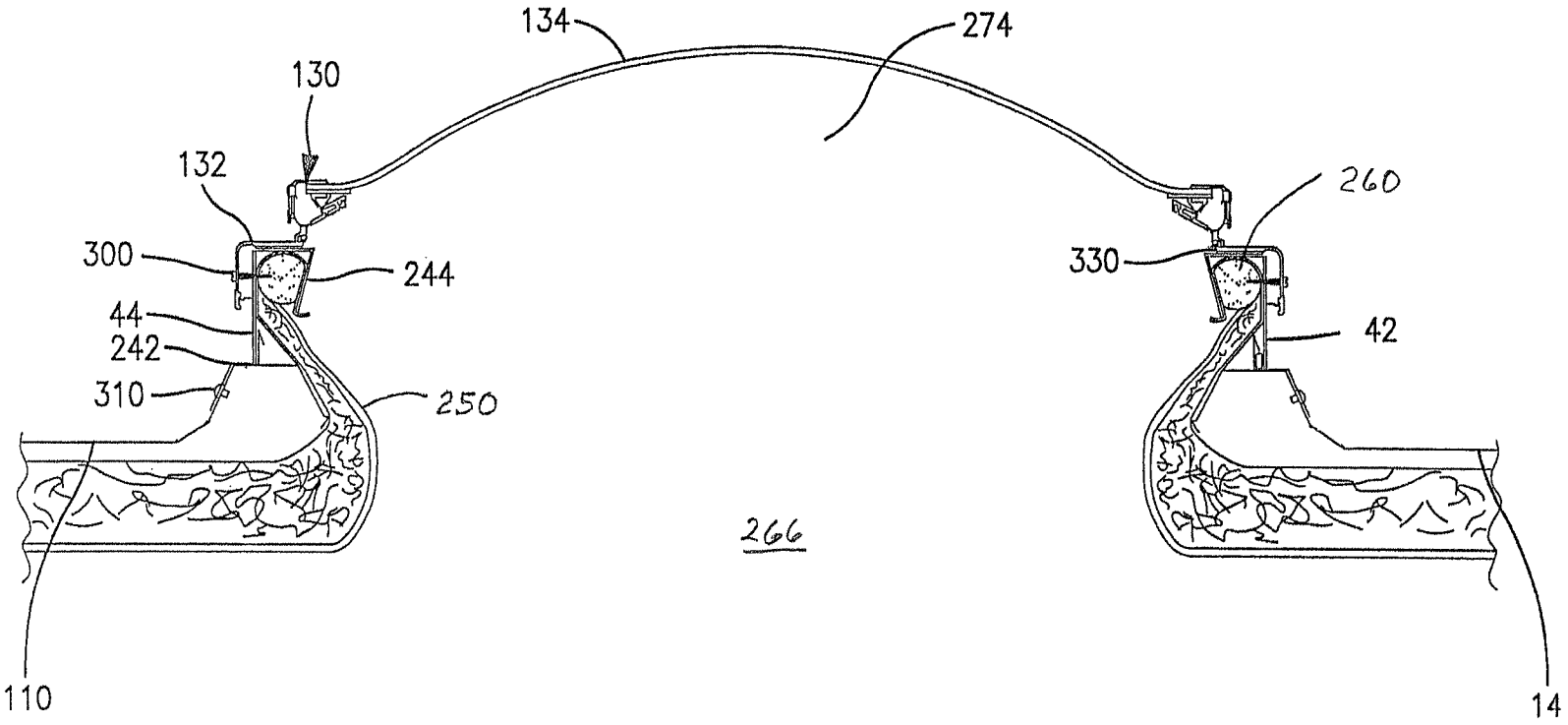
FIG. 8 shows a cross-section as in FIG. 7 where the insulation on both sides of the aperture has been raised, and tucked into a rail cavity, and is being held in the cavity; and the skylight lens subassembly has been mounted to the rails, serving as a cover over the aperture in the metal roof.

Referring now to FIGS. 7 and 8, a cross section through ribs 20, and associated support structures 100 shows securement of support structures 100 to standing rib portions of the standing seam panel roof 110. FIG. 7 depicts the use of ribs 20 to support side rails 42 and 44 on opposing sides of the panel flat 14. Each rail 42 or 44 has a lower rail shoulder 242 and a rail upper support structure 236. Rail upper support structure 236 has a generally vertically upstanding web 238, a generally horizontal rail upper flange or bearing panel 240, and a rail inside panel 244. Inside panel 244 extends toward outer panel 238 at an included angle of about 75 degrees between panel 240 and panel 244. From web 238, shoulder 242 extends laterally at a perpendicular angle over top flat rib surface 19 as a rail shoulder top, and turns at an obtuse included angle down, tracking the angle of the side of rib 20. The rail is secured to the side of rib 20 by fasteners 310 spaced along the length of the rib.

As illustrated in FIGS. 7 and 8, in each rib joint, the edges of the two next adjacent roof panels are folded together, one over the other, leaving a space between the bottom edges of the folded over panel edges and the underlying top flat rib surface 19. Where the space faces web 238 of the rail, as at the right side of FIG. 7, a gap plug 243 is disposed in the space between the standing seam and under the turned-over edge, and upstanding web 238 of the rail. Gap plugs 243 are used both where the upper diverter meets the side rails and where the lower closure meets the side rails.

Where the space faces away from upstanding web 238 of the side rail, as at the left side of FIG. 7, the flat surface of upstanding web 238 can be brought into a close enough relationship with the standing seam that any spaces between the standing seam and the upstanding web can be closed by tube sealants. Thus, no gap plug is typically used between upstanding web 238 and standing seam 18 where the edge of the seam is turned away from the upstanding web.

Gap plug 243 is relatively short, for example about 1.5 inches to about 2.5 inches long, although longer plugs are contemplated, and plug 243 has a width/height cross-section which loosely fills the space. The remainder of the space, about plug 243, namely between plug 243 and upstanding web 238, and between plug 243 and the standing seam, is filled with e.g. a pliable construction tube sealant. Plug 243 thus provides a solid fill piece at such spaces where there is some risk of water entry into the roof aperture, and where the space is too large for assurance that tube sealant can prevent such water entry.

Referring back to FIG. 7, insulation 248 is shown below the aperture 249 in the metal roof panel. Insulation 248 has a facing sheet 250 underlying a layer of e.g. fiberglass batt material 252. Dashed line 254 outlines the approximate portion of the fiberglass batt material which is to be removed. An edge portion 256 of batt material is left extending into aperture 249 for use described e.g. with respect to FIG. 8.

Rail and closure structure 40 is representative of support structure 100. Rails 42, 44 fit closely along the contours of ribs 20. Upper diverter 46 and lower closure 50 have contours which match the cross-panel contours of the metal roof panel at the respective ribs 20 as well as the flats 14 which are faced by the diverter and the closure. The various mating surfaces of structure 40 and roof 110 can be sealed in various ways known to the roofing art, including caulk or tape mastic. Plastic or rubber fittings or inserts such as plugs 243 and 460 can be used to fill larger openings at the rails and ribs.

In FIG. 8, the insulation batt material, marked with a dashed outline in FIG. 7, is relocated from its position under the central portion of the opening in the metal roof panel. Almost all of the batt material from that portion of the facing sheet has been removed. The facing sheet has been cut the full length of the roof-penetrating aperture 249 over which the one or more skylight lenses are to be installed. At the ends of aperture 249, the cut is spread to the corners of the opening. A such "Y"-shaped cut 262 is illustrated at the upper end of the opening in FIG. 6, wherein the ends of the "Y" extend to approximately the upper corners of the opening.

FIG. 8 shows the facing sheet lifted out of the aperture 249. The facing sheet and edge portions 256 of the insulation batting have been raised. A resilient foam retaining rod 260 has been forced into cavity 264 in the rail, with the facing sheet captured between the retaining rod and the rail surfaces which define cavity 264, which holds the insulation batting of edge portion 256 against the respective rib 20. Facing sheet 250 enters cavity 264 against upstanding web 238 of the rail, extends up and over/about rod 260 in the cavity, and thence extends back out of cavity 264 to a terminal end of the facing sheet outside cavity 264. Thus, rod 260 holds edge portion 256, as thermal insulation, against rib 20, and also positions the facing sheet vapor barrier between the climate-controlled space 266 inside the building and the perimeter of the support structure.

The uncompressed, rest cross-section of rod 260 is somewhat greater than the slot-shaped opening 268 between inside panel 244 and upstanding web 238. Thus retainer rod 260 necessarily is deformable, and the cross-section of the rod is compressed as the rod is being forced through opening 268. After passing through opening 268, rod 260 expands against web 238, and panels 240, 244 of the cavity while remaining sufficiently compressed to urge facing sheet 250 against web 238 and panels 240 and 244 of the cavity whereby facing sheet 250 is assuredly retained by friction in cavity 264 over the entire length of the rail or rails. A highly resilient, yet firm, polypropylene or ethylene propylene copolymer foam is suitable for rod 260. A suitable such rod, known as a "backer rod" is available from Bay Industries, Green Bay, Wis.

Upper diverter 46 and lower closure 50, discussed in more detail elsewhere herein, extend across the flat of the metal roof panel adjacent the upper and lower ends of roof aperture 249 to complete the closure of support structure 100 about the perimeter of aperture 249. The upper diverter and the lower closure have rail upper support structures 237 and 400 having cross-sections corresponding to the cross-sections of upper support structures 237 of rails 42, 44. Those upper support structures thus have corresponding flange cavities which are used to capture facing sheet 250 at the upper diverter and lower closure. Thus, the facing sheet is trapped in a cavity at the upper reaches of the rail and closure structure about the entire perimeter of the rail and closure structure. Bridging tape or the like is used to bridge between the side portions and end portions of insulation facing sheet 250 at the "Y" cuts at the ends of support structure 100, such that the facing sheet, in combination with the tape, completely separates the interior of skylight cavity 274 from the respective elements of support structure 100 other than inside panel 244.

FIG. 8 shows facing sheet 250 trapped in the rail cavities on both sides of the roof aperture. FIG. 8 further shows the skylight subassembly, including frame 12 and lens 134, mounted to rails 42, 44. A sealant 330 is disposed between bearing panel 240 and skylight frame 132, to seal against the passage of water or air across the respective joint. A series of fasteners 300 extend through upstanding web 238 of the rail and extend into resilient rod 260, whereby rod 260 insulates the inside of the roof aperture from the temperature differential, especially cold, transmitted by fasteners 300, thereby to avoid fasteners 300 being a source of condensation inside the skylight cavity 274, namely below the skylight lens.

Figure 9:
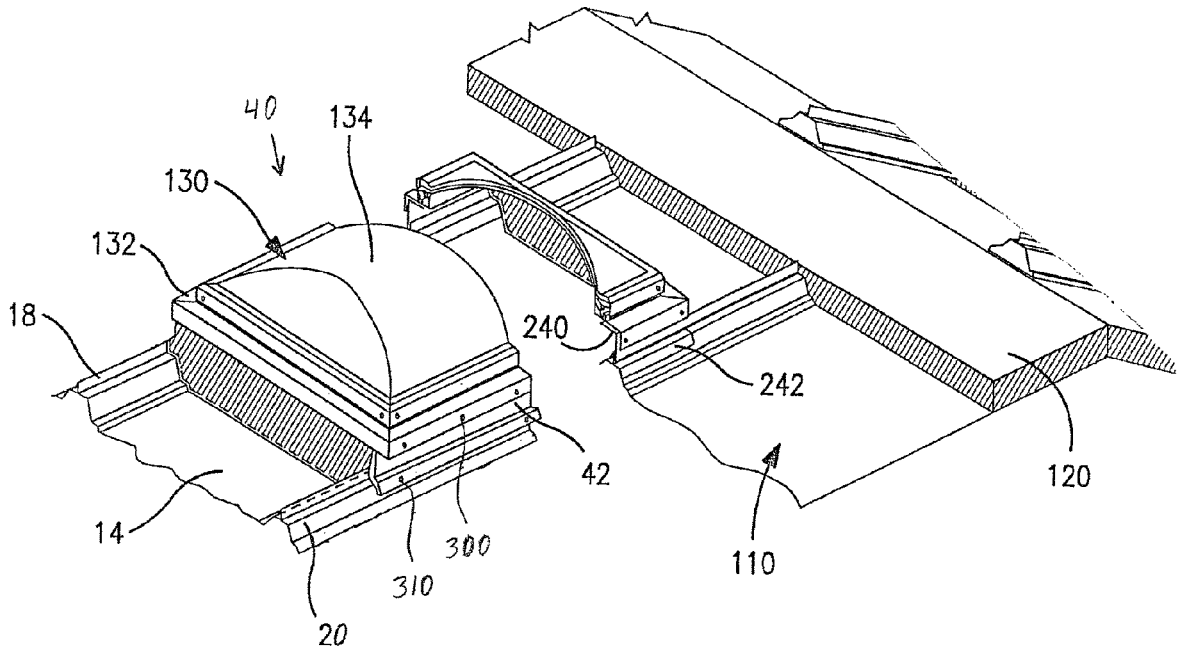
FIG. 9 is a perspective view partially cut away showing some internal structure of the system as installed on the rib elevations of a metal panel roof.

In FIG. 9 a partially cut away perspective view of a rail and closure structure 40 is used to show support of the rail and closure structure by standing seam panel roof 110, particularly the elevated rib 20 providing the structural support at the standing seams. FIG. 9 illustrates how the rail and closure structure cooperates with the structural profiles of the roof panels of the metal roof structure above and below the skylights, including following the elevations and ribs in adjacent ones of the panels, and thereby providing the primary support, by the roof panels, for the loads imposed by the skylights. In this fashion, the support structures of the invention adopt various ones of the advantages of a standing seam roof, including the beam strength features of the ribs at the standing seam, as well as the water flow control features of the standing seam.

Most standing seam roofs are seamed using various clip assemblies that allow the roof panels to float/move relative to each other, along the major elevations, namely along the joints between the respective roof panels, such joints being defined at, for example, elevated ribs 20. By accommodating such floating of the panels relative to each other, each roof panel is free to expand and contract according to e.g. ambient temperature changes irrespective of any concurrent expansion or contraction of the next-adjacent roof panels. Typically, a roof panel is fixed at the eave and allowed to expand and contract relative to a ridge. In some roofs, the panels are fixed at midspan, whereby the panels expand and contract relative to both the eave and ridge.

The design of the skylight systems of the invention takes advantage of such floating features of contemporary roof structures, such that when skylight assemblies of the invention are secured to respective rib elevations as illustrated herein, the skylight assemblies, themselves, are supported by the roof panels at ribs 20. Thus, the skylight assemblies, being supported by, and attached only to, the roof panels, move with the expansion and contraction of the respective roof panels to which they are mounted.

As seen in FIG. 8, skylight frame 132 is secured by a series of fasteners 300 to rail and closure structure 40 at side rails 42 and 44, and rails 42 and 44 are secured to ribs 20 by a series of fasteners 310.

In the process of installing a skylight system of the invention, a short length of one of the ribs 20, to which the closure support structure is to be mounted, is cut away, forming gap 122 in the respective rib, to accommodate drainage at that end of the rail and closure structure which is relatively closer to ridge cap 120. Such gap 122 is typically used with standing seam, architectural standing seam, and snap seam roofs, and can be used with any other roof system which has elevated elongate joints and/or ribs.

In the retained portions of rib 20, namely along the full length of the skylight as disposed along the length of the respective roof panel, the standing seams 18 which extend up from top flat rib surfaces 19, provide beam-type structural support, supporting side rails 42 and 44 and maintaining the conventional watertight seal at the joints between the metal roof panels, along the length of the assembly.

As part of the installation of upper diverter 46, support plate structure 48, shown in dashed outline FIG. 6, follows the width dimension contour of the roof panel, and is placed against the bottom surface of the respective roof panel at or adjacent the upper end of the opening in the roof and underlying lower flange 410 of the upper diverter. Self-drilling fasteners are driven through lower flange 410, through the metal roof panel and into support plate 48, drawing the diverter, the roof panel, and the support plate structure into facing contact with each other and thus trapping the roof panel between the support plate and the diverter and closing off the interface between the roof panel and the diverter. Thus, support plate 48 acts as a nut for tightening such fasteners. Caulk or other sealant is used to further reinforce the closure/sealing of the diverter/roof panel interface.

Support plate 48 can also be used to provide lateral support, connecting adjacent ribs 20 to each other. Support plate 48 is typically steel or other material sufficient to provide a rigid support to the skylight rail and closure structure at diverter 46. An exemplary material for support plate 48 is 14 gauge steel.

Rail and closure structure 40 is configured such that the skylight subassembly can be fastened directly to the rails with rivets or other fasteners such as screws and the like as illustrated at 310 in FIG. 8.

The cross-section profiles of plugs 460 approximate the cross-section profiles of the cavities inside the respective rib 20. Thus plugs 460, when coated with tape mastic and tube caulk, provide a water-tight closure in the upstream side of the cut rib, and a back-up water-tight closure in the downstream side of the cut rib. Accordingly, water which approaches upper diverter 46 is diverted by diversion panel 420 and flange 410 and secondarily by web 415, toward extension 450, thence through gap 122 in and through the rib, away from the high end of closure support structure 100 and onto the flat portion of the next laterally adjacent roof panel. Accordingly, so long as the flow channel through gap 122 remains open, water which approaches the skylight assembly from above upper diverter 46 is directed, and flows through, gap 122 and away from, around, the respective skylight assembly.

Figure 13:
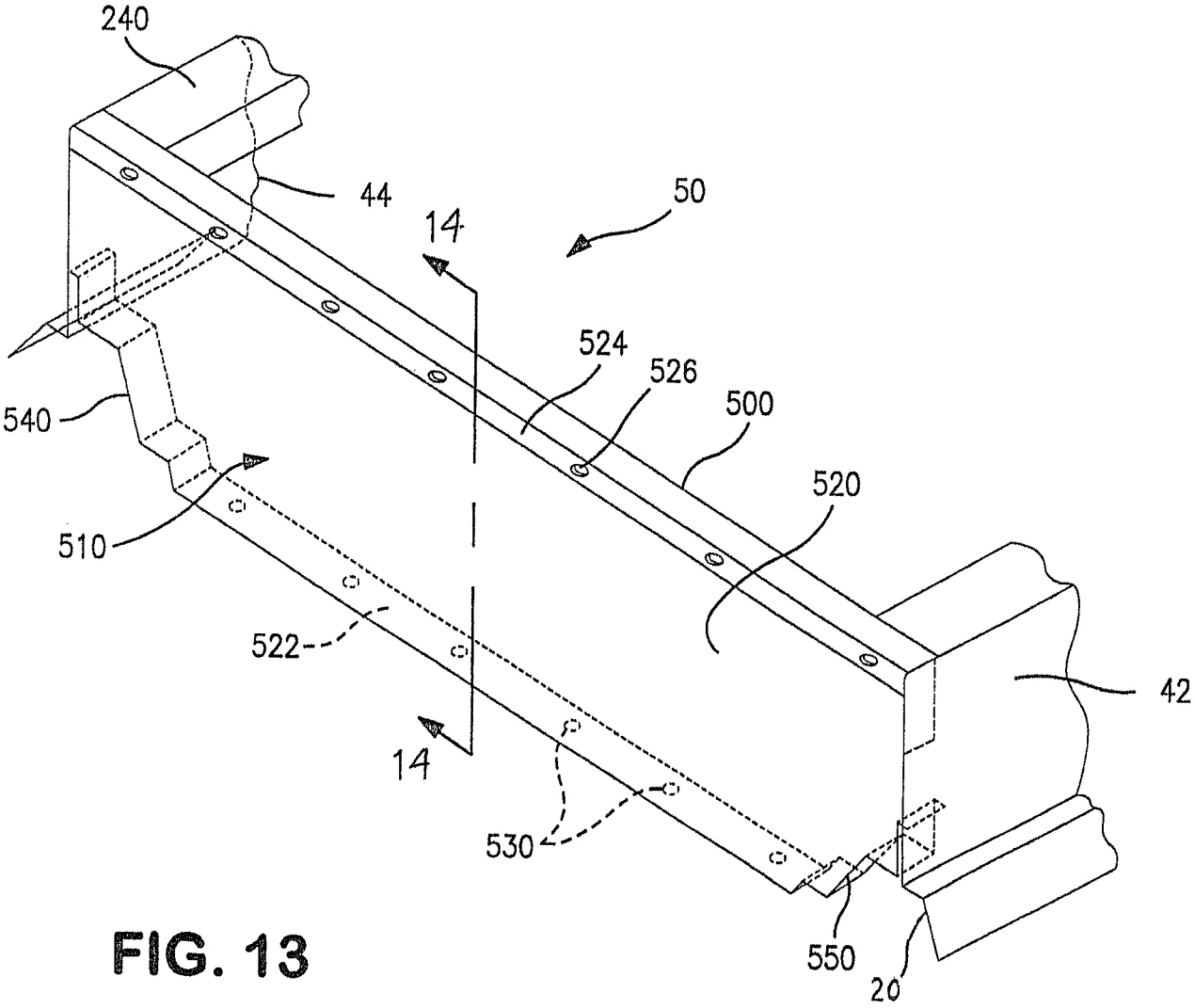
FIG. 13 is a perspective view of the lower closure.
Figure 16:
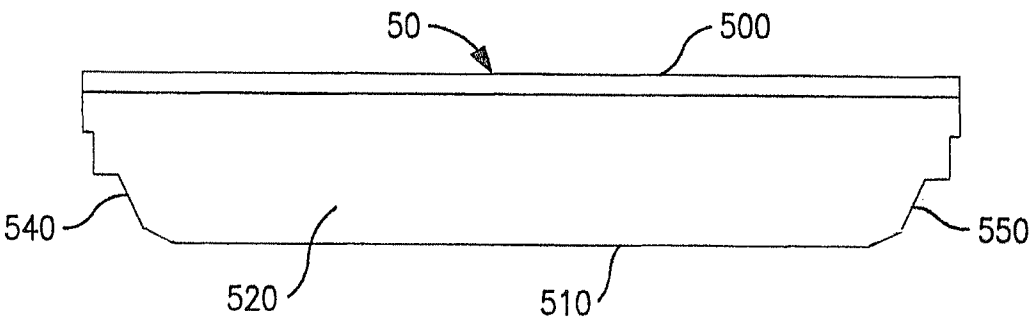
FIG. 16 is an elevation view of the lower closure of FIG. 13.

FIGS. 9, and 13-16 show lower closure 50. The lower closure is used to establish and maintain a weather tight seal at the lower end of rail and closure structure 40, namely at the lower end of roof aperture 249. As illustrated in FIGS. 9, 13, and 16, the bottom surface of closure 50 is contoured to follow the profiles of ribs 20, thus to extend up along a cross-section of a rib in surface-to-surface relationship with, as well as to follow the contour of panel flat 14 across the width of the panel. Bottom closure 50 abuts the down-slope ends of side rails 42 and 44, and the height of closure 50 matches the heights of side rails 42, 44.

Figure 14:
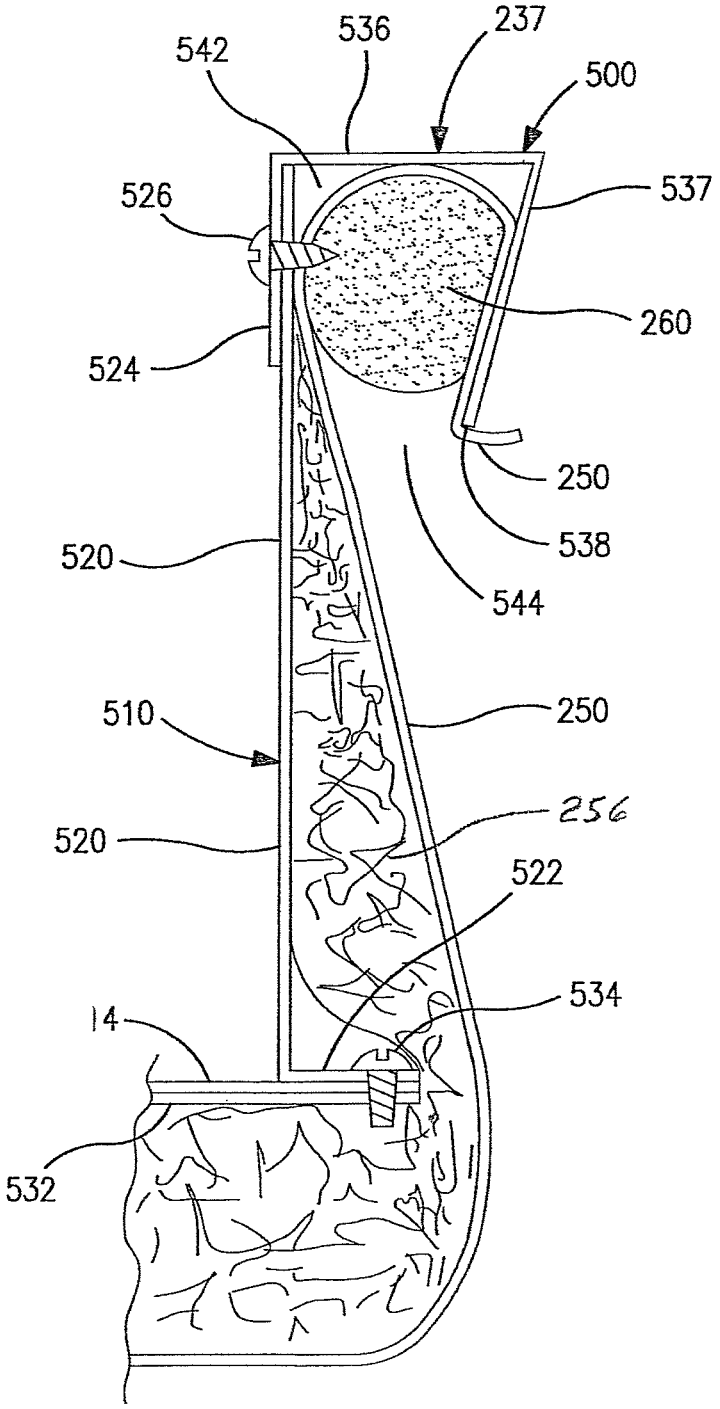
FIG. 14 is a cross-section of the lower closure taken at 14-14 of FIG. 13.
Figure 15:
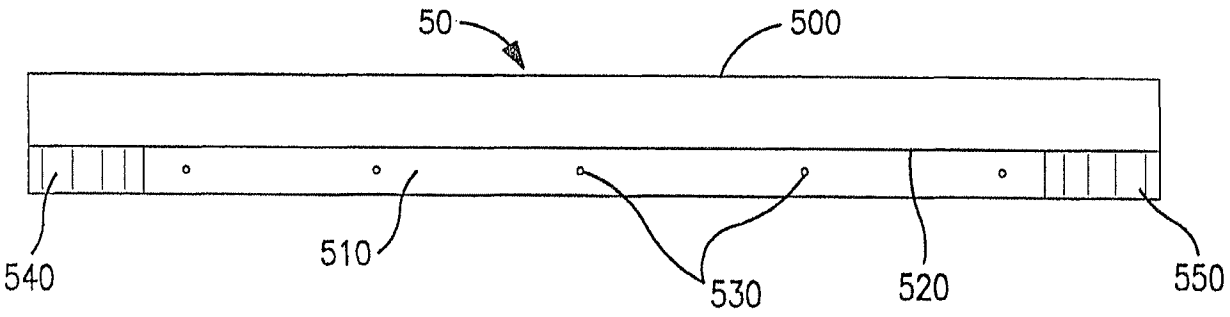
FIG. 15 is a top view of the lower closure of FIG. 13.

Referring to FIGS. 13 and 14, lower closure 50 has a bottom portion 510 and an upper rail 500 secured to the bottom portion. Bottom portion 510 has a lower flange 522, as well as a closure web 520. Lower flange 522 is in-turned, namely flange 522 extends inwardly of closure web 520, toward the roof aperture and includes fastener holes 530. A stiff, e.g. steel, support plate 532, similar in thickness to support plate 48, extends the width of the panel flat under lower flange 522. Self-drilling screws 534 extend through holes 530, through the panel flat, and into the support plate. Support plate 532 acts as a nut for the respective screws 534, whereby the screws can firmly secure the lower flange to the panel flat and provide support to that securement. Tube sealants can be used to enhance such closure.

Upper rail 500 is an elongate inverted, generally U-shaped structure. A first downwardly-extending leg 524 has a series of apertures spaced along the length of the rail, and screws 526 or other fasteners which extend through leg 524 and through closure web 520, thus mounting rail 500 to bottom portion 510.

Rail 500 extends, generally horizontally, from leg 524 inwardly and across the top of closure web 520, along bearing panel 536 to inside panel 537. Inside panel 537 extends down from bearing panel 536 at an included angle, between panels 536 and 537, of about 75 degrees to a lower edge 538.

Thus, the upper rail of the lower closure, in combination with the upper region of closure web 520, defines a cavity 542 which has a cavity cross-section corresponding with the cross-sections of cavities 264 of rails 42, 44. As with cavities 264 of the side rails, retaining rod 260 has been compressed in order to force the rod through slot 544, capturing facing sheet 250 between the retaining rod and the surfaces which define cavity 542. The facing sheet has been raised. Facing sheet 250 traverses cavity 542 along a path similar to the path through cavities 264. Thus, facing sheet 250 enters cavity 542 against the inner surface of closure web 520, extends up and over/about rod 260 in the cavity, against panels 536 and 537, and back out of cavity 542 to a terminal end of the facing sheet outside cavity 542. The tension on facing sheet 250 holds edge portion 256 of the batting against bottom portion 510 of the lower closure.

The uncompressed, rest cross-section of rod 260 in cavity 542 is somewhat greater than the cross-section of slot-shaped opening 544 between inside panel 537 and closure web 520, whereby rod 260 is necessarily compressed while being inserted through slot 544 and into cavity 542. After passing through opening 544, rod 260 expands against panels 520, 536, and 537 of the cavity while remaining sufficiently compressed to urge facing sheet 250 against panels 520, 536, and 537 whereby facing sheet 250 is assuredly retained in cavity 542.

As with screws 300 which mount the skylight assembly to side rails 42, 44, upper diverter 46, and lower closure 50, screws 526 extend through rail 500, through closure web 520, and into rod 260, whereby rod 260 insulates the inside of the roof aperture from temperature differentials transmitted by screws 526, thereby to avoid the fasteners being a source of condensation inside space 274 below the skylight lens.

Upper rail 500 of the lower closure extends inwardly, toward aperture 249, of closure web 520 at a common elevation with bearing panels 240 of the side rails. Collectively, the bearing panels of side rails 42, 44, lower closure 50, and upper diverter 46 form a consistent-height top surface of the rail and closure structure, which receives the skylight lens subassembly.

Closure 50 includes rib mating flanges 540 and 550, as extensions of lower flange 522, to provide tight fits along ribs 20.

A salient feature of support structures 100, relative to conventional curb-mounted skylights, is the fact that the full lengths of the entireties of the sides, namely the side rails, are above the panel flats, namely above the typical high water lines of the respective metal roof panels.

In the process of installing the closure support structure, the upper diverter is installed first, after cutting a small portion of the aperture near the diverter. Then the remainder of the roof aperture is cut in the respective roof panel and the rails are installed.

Or if the support structure is being used as a replacement for an in-the-flat skylight panel, the aperture already exists; and the support structure is located so as to either enclose or otherwise protect, as with the extended length lower flange on the diverter, the fastener holes which were used with the skylight panel which is being replaced; and the diverter is installed accordingly.

The lower closure is then installed, which defines the perimeter bearing surfaces for the skylight assembly. The skylight assembly is then mounted on the perimeter bearing surfaces and secured to the rails. Tube sealant and tape mastic are applied, as appropriate, at the respective stages of the process to achieve leak-free joints between the respective elements of the closure assembly.

As indicated above, the weight of a load received at 42, 44 is transferred directly to ribs 20 of the respective underlying roof panels, optionally along the full lengths of the support structure; and only a minor portion, such as less than 10% if any, of that weight is borne by the panel flat, and only at the upper end and at the lower end of the support structure. Thus, the weight of the rails, or of the support structure, is borne by the strongest elements of the roof panels, namely the ribs.

As a general statement, rail and closure structures of the invention close off the roof aperture from unplanned leakage of e.g. air or water through the roof aperture. The rail and closure structure 40 extends about the perimeter/sides of the roof aperture and extends from the respective metal roof panel upwardly to the top opening in the rail and closure structure. The lens subassembly overlies the top opening in the rail and closure structure and thus closes off the top opening to complete the closure of the roof aperture.

Support structure 100 thus is defined at least in part by rail and closure structure 40 about the perimeter of the roof aperture, and skylight lens subassembly 130, or the like, overlies the top of the rail closure structure and thus closes off the top of the closure support structure over the roof aperture.

Rail and closure structure 40 has been illustrated in detail with respect to a standing seam roof illustrated in FIG. 1. In light of such illustration, those of skill in the art can now adapt the illustrated rail and closure structures, by modifying, shaping of the structure elements, to support loads from any roof system which has a profile which includes elevations, above the panel flat, using standing joints or other raised elevations, as the locus of attachment to the roof.

While the figures depict a skylight, the support structure can be used to mount a wide variety of loads on such roof, including various types of skylights, smoke vents, air conditioning, other vents, air intakes, air and other gaseous exhausts, electrical panels or switching gear, and/or other roof loads, including roof-penetrating structures, all of which can be supported on support structures of the invention.

So far, the upper diverter having an extended-length lower flange has been described in the context of being used when an in-the-flat panel is being replaced. Such extended length flange also finds use where the up-slope end of aperture 249 is relatively close to ridge 120. In such event, the distal end of the lower flange can abut, or overlap the down-slope end of, ridge 120. Where the lower flange is to abut an up-slope structure such as ridge 120, and thus to bridge the respective distance, the length of the lower flange, between the proximal and distal ends of the lower flange, is specified according to the distance to be bridged.

The metal roof panels are exposed to the ambient environment outside the building and thus expand and contract according to changes in the ambient environment outside the building. Building framing members are exposed to the ambient environment inside the building and thus expand and contract according to changes in the ambient environment inside the building. Ambient temperatures outside the building can differ substantially from the ambient temperatures inside the building. Accordingly, expansion and contraction of the metal roof panels on the outside of the building occurs at different rates and at different times than expansion and contraction of the building framing members.

In-the-flat daylighting panels, such as those illustrated in FIGS. 2 and 3, rely for support on the ends of the daylighting panels overlying the purlins, whereby the purlins provide support for the daylighting panels at the opposing ends of the daylighting panels.

By contrast, the daylighting structures, the support structures of the invention are supported solely by the ribs of the metal roof panels, and are not at all supported by the purlins or any other building framing member.

Because the support structures of the invention are mounted solely to elements of the roof, it is critical that all elements of the support structures be able to expand and contract along with the elements of the roof to which they are mounted, without being hindered by any of the underlying building framing members.

A hindrance that could occur would be if one or more of the screws and/or rivets which extend through e.g. holes 530 were to contact a purlin as a result of expansion or contraction of the roof and/or the support structure. If such rivet or screw were to contact a purlin, such contact could hinder further movement of the screw or rivet, which could result in buckling and/or tearing of the respective roof panel. Therefore, it is critical that both the upper diverter and lower closure be positioned, along the length of the metal roof panel, such that there is no interference, no contact, at any condition of expansion or contraction between any of the mechanical fasteners, e.g. screws or rivets, and any of the purlins. Such positioning of the diverter and closure is, of course, influenced by the location of aperture 249.

FIG. 5 illustrates such positioning of aperture 249 and the three closest purlins 34. FIG. 5 shows that all of holes 430 and 530 are displaced from the respective purlins a sufficient distance that no amount of expansion or contraction will bring any of holes 430 or 530 to any edge of any of the purlins.

Although the invention has been described with respect to various embodiments, this invention is also capable of a wide variety of further and other embodiments within the spirit and scope of the appended claims.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A method of replacing a previously-installed daylighting panel mounted on an underlying metal roof panel of a standing seam metal panel roof on an underlying building, such roof panel having opposing first and second sides, a first length, and a first width between the first and second sides, first and second rib elements being disposed on the opposing first and second sides of the roof panel, and a panel flat being disposed between the rib elements, the rib elements of adjacent such metal roof panels being joined to each other in defining ribs on opposing sides of each such roof panel, such previously-installed daylighting panel overlying an aperture in such roof panel, such aperture extending along a length of such roof panel, in the area of the panel flat and proximate the elevation of the panel flat, such daylighting panel having an up-slope end and being mounted by mechanical fasteners to such roof, such mechanical fasteners extending through holes in such metal roof panel at such panel flat, including holes in the panel flat up-slope of the aperture, and wherein at least some of such holes in the panel flat up-slope of such aperture are spaced from such aperture by at least 2 inches, the method comprising:

(a) removing the previously-installed daylighting panel from the underlying metal roof panel, including removing the mechanical fasteners from the previously-installed daylighting panel and the metal roof panel and thereby exposing the aperture in the roof panel to the ambient environment, which exposes an access path through the aperture and into the underlying building, and leaves, in the metal roof panel, the fastener holes which had been used to mount the previously-installed daylighting panel to the roof panel;

(b) mounting a support structure to the roof and about the aperture, the support structure comprising (i) first and second side rails mounted to respective ones of the ribs and thereby defining opposing sides of the support structure, each such side rail having an up-slope end and a down-slope end, (ii) a lower closure mounted to the roof such that the lower closure extends across a width of the support structure from the first side rail to the second side rail, and closes off access to the aperture from outside the building and down-slope of the support structure, including closing off access to any pre-existing fastener holes in the metal roof panel which are down-slope of the aperture, and (iii) an upper diverter mounted to the roof, the upper diverter having a second length extending in a common direction with the first length of the respective roof panel, and a second width extending in a common direction with the first width of the respective roof panel, the upper diverter extending across the width of the support structure from the first side rail to the second side rail, and closing off access to the aperture from up-slope of the support structure, including closing off access to any pre-existing fastener holes in the metal roof panel which are up-slope of the aperture, the upper diverter comprising A. a lower flange having a third length extending along the length of the upper diverter, and B. an upstanding wall having first and second ends, and a fourth length extending between the first and second ends and along the width of the upper diverter, the upstanding wall forming a joint with the lower flange at a lower edge of the upstanding wall, the third length of the lower flange extending from a down-slope end thereof at the upstanding wall, past all such pre-existing holes in the panel flat, to an up-slope end of the lower flange remote from the upstanding wall and thereby closing off access, from outside the building, to any such pre-existing fastener holes in the panel flat, which are up-slope of the aperture; and (c) mounting a daylighting lens assembly, comprising a daylighting lens, over the support structure and thereby closing off the access path into the underlying building.

2. A method as in claim 1, the upper diverter further comprising an upper flange joined to, and extending transversely to, a top of the upstanding wall, the upper flange having third and fourth ends, the lower flange having a lateral leg which extends along the width of the upper diverter and beyond the third end of the upper flange, the lateral leg having a down-slope side and an up-slope side: the length of the lower flange extending beyond, and up-slope from, the up-slope side of the lateral leg.

3. A method as in claim 1, the lower flange having a top surface and a bottom surface, first and second ends, and opposing first and second sides, the upper diverter further comprising first and second rib mating webs extending upwardly from, and transverse to, the top surface of the lower flange at the opposing first and second sides of the lower flange.

4. A method as in claim 1 wherein the side rails extend upwardly above the roof panel ribs.

5. A method as in claim 4 wherein the daylighting lens extends across the support structure at an elevation above the roof panel ribs.

6. A method as in claim 1, the upper diverter further comprising an upper flange extending from the upstanding wall, the upper flange having opposing third and fourth ends, the lower flange having a lateral leg which extends along the width of the upper diverter and beyond the third end of the upper flange, further comprising cutting a gap through one of the ribs at the opposing sides of the respective roof panel, and installing the lateral leg in the resulting rib gap.

7. A method of replacing a previously-installed daylighting panel mounted on an underlying metal roof panel of a standing seam metal panel roof on an underlying building, such roof panel having opposing first and second sides, a first length, and a first width between the first and second sides, first and second rib elements being disposed on the opposing first and second sides of the roof panel, and a panel flat being disposed between the rib elements, the rib elements of adjacent such metal roof panels being joined to each other in defining ribs on opposing sides of each such roof panel, such previously-installed daylighting panel covering an aperture in such roof panel, such aperture extending along a length of such roof panel, in the area of the panel flat and proximate the elevation of the panel flat, such daylighting panel having an up-slope end and being mounted to such roof by mechanical fasteners, such mechanical fasteners extending through holes in such metal panel roof at such panel flat, including holes in the panel flat of the roof panel up-slope of the aperture, and wherein at least some of such holes in the panel flat up-slope of such aperture are spaced from such aperture by at least 2 inches, the method comprising:

(a) removing the previously-installed daylighting panel from the underlying metal roof panel, including removing the mechanical fasteners from the previously-installed daylighting panel and the metal roof panel and thereby exposing the aperture in the roof panel to the ambient environment, which exposes an access path through the aperture and into the underlying building, and leaves, in the metal roof panel, the fastener holes which had been used to mount the previously-installed daylighting panel to the metal roof panel;

(b) mounting a support structure to the roof and about the aperture, the support structure comprising (i) first and second side rails mounted to the roof on opposing sides of the aperture and thereby defining opposing sides of the support structure, each such side rail having an up-slope end and a down-slope end, (ii) a lower closure mounted to the roof such that the lower closure extends across a width of the support structure from the first side rail to the second side rail, and closes off access to the aperture from outside the building and down-slope of the support structure, including closing off access to any pre-existing fastener holes, in the metal roof panel, which were exposed by the removing of the previously-installed daylighting panel, and which fastener holes are down-slope of the aperture, and (iii) an upper diverter mounted to the roof, the upper diverter having a second length extending in a common direction with the first length of the respective roof panel, and a second width extending in a common direction with the first width of the respective roof panel, the upper diverter extending across the width of the support structure from the first side rail to the second side rail, and closing off access to the aperture from up-slope of the support structure, including closing off access to any pre-existing fastener holes in the metal roof panel which are up-slope of the aperture, the upper diverter comprising A. a lower flange having a third length extending along the length of the upper diverter, the lower flange being adapted and configured to interface with the respective underlying roof panel, and B. an upstanding wall having first and second ends, and a fourth length extending between the first and second ends and along the width of the upper diverter, the upstanding wall forming a joint with the lower flange at a lower edge of the upstanding wall, the third length of the lower flange extending, from a down-slope end thereof at the upstanding wall, up-slope on the roof panel, and over and past all such pre-existing holes in the panel flat up-slope of the up-slope end of the aperture, to an up-slope end of the lower flange remote from the upstanding wall and thereby interfacing with edges of, and closing off access, from outside the building, to any such pre-existing fastener holes in the panel flat, which are up-slope of the aperture; and (c) mounting a daylighting lens assembly, comprising a daylighting lens, in overlying relationship over the support structure and thereby closing off the access path into the underlying building.

8. A method as in claim 7, the upper diverter further comprising an upper flange joined to, and extending transversely to, a top of the upstanding wall, the upper flange having third and fourth ends, the lower flange having a lateral leg which extends along the width of the upper diverter and beyond the third end of the upper flange, the lateral leg having a down-slope side and an up-slope side, the length of the lower flange extending beyond, and up-slope from, the up-slope side of the lateral leg.

9. A method as in claim 7, the lower flange having a top surface and a bottom surface, first and second ends, and opposing first and second sides, the upper diverter further comprising first and second rib mating webs extending upwardly from, and transverse to, the top surface of the lower flange at the opposing first and second sides of the lower flange.

10. A method as in claim 7 wherein the side rails extend upwardly above the roof panel ribs.

11. A method as in claim 10 wherein the daylighting lens extends across the support structure at an elevation above the roof panel ribs.

12. A method as in claim 7, the upper diverter further comprising an upper flange extending from the upstanding wall, the upper flange having opposing third and fourth ends, the lower flange having a lateral leg which extends along the width of the upper diverter and beyond the third end of the upper flange, further comprising cutting a gap through one of the ribs at the opposing sides of the respective roof panel, and installing the lateral leg in the resulting rib gap.

13. A method of replacing a previously-installed daylighting panel mounted on an underlying metal roof panel of a standing seam metal panel roof, such roof panel having opposing first and second sides, a first length, and a first width between the first and second sides, first and second rib elements being disposed on the opposing first and second sides of the roof panel, and a panel flat being disposed between the rib elements, the rib elements of adjacent such metal roof panels being joined to each other in defining ribs on opposing sides of a such roof panel, such previously-installed daylighting panel overlying an aperture in such roof panel, such aperture extending along a length of such roof panel, in the area of the panel flat and proximate the elevation of the panel flat, such daylighting panel having an up-slope end and being mounted to such roof by mechanical fasteners, such mechanical fasteners extending through holes in such metal roof panel at such panel flat, including through holes in the panel flat up-slope of the aperture, the method comprising:

(a) removing the previously-installed daylighting panel from the underlying metal roof panel, including removing the mechanical fasteners from the previously-installed daylighting panel and the metal roof panel, which exposes an access path through the aperture and into the underlying building, and leaves, in the metal roof panel, the fastener holes which had been used to mount the previously-installed daylighting panel to the metal roof panel;

(b) cutting a rib gap through one of the ribs on the opposing sides of the respective roof panel adjacent the up-slope end of the aperture;

(c) mounting a support structure to the roof and about the aperture, the support structure comprising (i) first and second side rails mounted to the roof on opposing sides of the aperture and thereby defining opposing sides of the support structure, each such side rail having an up-slope end and a down-slope end, (ii) a lower closure mounted to the roof such that the lower closure extends across a width of the support structure, and closes off access to the aperture from outside the building and down-slope of the support structure, including closing off outside access to any pre-existing fastener holes, in the metal roof panel, which were exposed by the removing of the previously-installed daylighting panel, and which fastener holes are down-slope of the aperture, and (iii) an upper diverter mounted to the roof, the upper diverter having a second length extending in a common direction with the first length of the respective roof panel, and a second width extending in a common direction with the first width of the respective roof panel, the upper diverter extending across the width of the support structure, closing off access to the aperture from up-slope of the support structure, and closing off outside access to any pre-existing fastener holes in the metal roof panel which are up-slope of the aperture, the upper diverter comprising A. a lower flange having a third length extending along the length of the upper diverter, and extending through the rib gap, and B. an upstanding wall having first and second ends, and a fourth length extending between the first and second ends and along the width of the upper diverter; and (d) mounting a daylighting lens assembly, comprising a daylighting lens, in overlying relationship over the support structure and thereby closing off the access path into the underlying building.

14. A method as in claim 13, including not cutting a rib gap through the other of the ribs on the opposing side of the respective roof panel.

15. A method as in claim 13, the lower flange extending up-slope of the lateral leg.

* * * * *